US009657406B2

(12) United States Patent
Asa et al.

(10) Patent No.: US 9,657,406 B2
(45) Date of Patent: May 23, 2017

(54) SURFACE TREATING APPARATUS AND PLATING TANK

(75) Inventors: Fujio Asa, Osaka (JP); Junji Mizumoto, Osaka (JP)

(73) Assignee: C. UYEMURA & CO., LTD., Osaka (JP)

( * ) Notice: Subject to any disclaimer, the term of this patent is extended or adjusted under 35 U.S.C. 154(b) by 394 days.

(21) Appl. No.: 13/526,265

(22) Filed: Jun. 18, 2012

(65) Prior Publication Data

US 2013/0001087 A1 Jan. 3, 2013

(30) Foreign Application Priority Data

Jun. 30, 2011 (JP) ..... 2011-145648

(51) Int. Cl.

| | |
|---|---|
| ***C25D 17/06*** | (2006.01) |
| ***C25D 5/08*** | (2006.01) |
| ***C25D 17/00*** | (2006.01) |
| ***C25D 17/10*** | (2006.01) |
| ***C25D 21/10*** | (2006.01) |

(52) U.S. Cl.

CPC ..... *C25D 17/008* (2013.01); *C25D 5/08* (2013.01); *C25D 17/005* (2013.01); *C25D 17/06* (2013.01); *C25D 17/10* (2013.01); *C25D 21/10* (2013.01)

(58) Field of Classification Search

CPC ..... C25D 17/00
USPC ..... 205/275.1; 414/222
See application file for complete search history.

(56) References Cited

U.S. PATENT DOCUMENTS

| | | | | |
|---|---|---|---|---|
| 3,751,354 | A | 8/1973 | Jones | |
| 4,740,284 | A * | 4/1988 | Bolte et al. | 204/198 |
| 6,672,820 | B1 | 1/2004 | Hanson et al. | |
| 2002/0079230 | A1 * | 6/2002 | Basol et al. | 205/157 |
| 2007/0108044 | A1 * | 5/2007 | Okuda et al. | 204/198 |
| 2008/0041726 | A1 | 2/2008 | Nakamoto et al. | |
| 2009/0218231 | A1 * | 9/2009 | Yajima et al. | 205/96 |

(Continued)

FOREIGN PATENT DOCUMENTS

| | | |
|---|---|---|
| JP | B-1989(SHO64)008077 | 2/1989 |
| JP | A-1994 (Hei 6)-101098 | 4/1994 |
| JP | A-2001-335991 | 12/2001 |

(Continued)

OTHER PUBLICATIONS

First Notification of Office Action (Including Translation) for corresponding Chinese Patent Application No. 201210209948.9, mailed Oct. 29, 2015.

(Continued)

*Primary Examiner* — Stefanie S Wittenberg

(74) *Attorney, Agent, or Firm* — Jason H. Vick; Sheridan Ross, PC

(57) ABSTRACT

To prevent a plate-like work in a plating tank from swinging to improve quality of plating and prevent dropout or damages of a printed circuit board during transportation. A plating tank 2*a* includes an upper guide rail 11 that is provided above the plating tank 2*a* and transports a transport hanger 15*a* in a moving direction and a lower guide rail 14 that is provided inside the plating tank 2*a* and generates an attractive force against a lower clamp 49 of the transport hanger 15*a*. In the plating tank 2*a*, an attractive force is generated while performing plate processing to pull the lower clamp 49 of the transport hanger 15*a* downward, thereby giving tension to a plate-like work W.

17 Claims, 27 Drawing Sheets

(56) References Cited

U.S. PATENT DOCUMENTS

| | | | | |
|---|---|---|---|---|
| 2009/0324369 | A1* | 12/2009 | Scollay | H01L 21/67173 414/222.01 |
| 2012/0107074 | A1 | 5/2012 | Kunze et al. | |

FOREIGN PATENT DOCUMENTS

| | | | |
|---|---|---|---|
| JP | A-2007-131869 | 5/2007 | |
| JP | 2006-316322 | * 11/2008 | C25D 17/00 |
| JP | U-3153550 | 9/2009 | |
| JP | 2010-024514 | 2/2010 | |
| JP | A-2010-100898 | 5/2010 | |
| JP | A-2010-106288 | 5/2010 | |
| JP | A-2010-121185 | 6/2010 | |

OTHER PUBLICATIONS

Official Action (Including Translation) for corresponding Taiwan Patent Application No. 101123537, mailed Apr. 24, 2016.

Official Action (Including Translation) for corresponding Taiwan Patent Application No. 101123537, mailed Apr. 26, 2016.

Notification of Reasons for Refusal (including translation) for corresponding Japanese Patent Application No. 2011-145648, mailed Feb. 9, 2015.

* cited by examiner

β2

β1−β1

β2

β1−β1

β2

β1−β1

SURFACE TREATING APPARATUS AND PLATING TANK

CROSS REFERENCE TO RELATED APPLICATIONS

This application claims the benefit under 35 U.S.C. 119(a) to Japanese Patent Application No. 2011-145648, filed Jun. 30, 2011, the entire disclosure of which is incorporated herein by reference in its entirety.

FIELD OF THE INVENTION

The present invention relates to a technique for electroplating a plate-like work such as a printed circuit board in a surface treating apparatus. More specifically, the present invention relates to a technique for improving quality of plate processing.

BACKGROUND ART

Description of Background Art (i) In a conventional surface treating apparatus, as shown in FIGS. 25A and 25B, surface treatment was performed on a plate-like work W fixedly attached to a rack on a transport hanger to prevent the work from shaking while transporting the rack. (JP-B-3153550U)

(ii) Also conventionally, in order to fix the plate-like work to the transport hanger, a clamp 48' (composed of a movable member 48*a*' and a fixed member 48*b*') in the shape shown in FIG. 26 was used. (JP-A-2007131869)

(iii) Additionally, there are other techniques related to plate processing such as a technique to prevent an electric field from branching into the plate-like work by arranging a porous plate in a flow path of a plating solution that flows toward the plate-like work to regulate the flow (JP-B-1989 (SHO64)008077 and JP-B-1994(HEI6)101098) and a technique to provide an additional electrode between the anode and the plate-like work so as to improve unevenness of the electric line of force that heads for the plate-like work (JP-A-2001335991).

Description of Problems to be Solved by the Invention (i) When a plate-like work such as a printed circuit board is supported by continuously stretching in a vertical direction on such a transport hanger as shown in FIGS. 25A and 25B, the printed circuit board may come off or may be broken in the case of a thin printed circuit board by a vertical impact of transportation or the like. On the other hand, in a plating tank, it is necessary for the printed circuit board to be kept stretched in order to undergo plating in a flat state. It is because if the plate-like work swings by a pressure of plating solution and undergoes plating in a bent state, the work would be defective.

(ii) A clamp of JP-A-2007131869 shown in FIG. 26 has an electrical asymmetry with respect to the printed circuit board, which generates a difference between amounts of electricity I1 and I2 that are respectively supplied to a front and back sides of the printed circuit board. This results in a problem in which the plating thickness is different between both sides of the printed circuit board.

(iii) When a flow of plating solution circulating in a plating tank is slow, a porous plate shown in JP-B-1989(SHO64) 008077 or JP-B-1994(HEI6)101098 was often arranged in the vicinity of the printed circuit board. However, it was thought to be inappropriate when a flow of plating solution is quick. Further, in a conductor-shell structure disclosed in JP-A-2001335991, although unevenness of the electric line of force can be improved, the flow of plating solution could not be effectively regulated.

SUMMARY OF THE INVENTION (1) A surface treating apparatus of this invention includes: a transport hanger for transporting a processing object; a plating tank having a tank body that stores a plating solution; and a rise-and-fall mechanism for lowering the transport hanger loaded with the processing object into the plating tank and lifting the transport hanger from the plating tank after performing plate processing on the processing object, in which the transport hanger includes an upper gripper for gripping an upper part of the processing object and a lower gripper for gripping a lower part of the processing object, and the plating tank includes an upper guide rail for transporting the transport hanger in a predetermined moving direction and a member that is provided at a predetermined position of the tank body and that generates an attractive force against the lower gripper of the transport hanger.

This makes it possible to stretch a work only in the plating tank, which is required for plate processing. Therefore, quality of plate processing can be improved and dropout or damages of a work caused by unnecessarily stretching the work can be protected.

(2) The plating tank according to this invention is a plating tank for electroplating a processing object characterized by including: a tank body that is provided to extend in a moving direction of the processing object and stores a plating solution; an anode provided in the tank body; a transport hanger moving in the moving direction while holding the processing object and including an upper and a lower grippers for respectively gripping the processing object at an upper and a lower parts thereof; an upper guide rail that is provided above the tank body and transports the transport hanger in the moving direction; and a member that is provided at a predetermined position in the tank body and generates an attractive force against the lower gripper of the transport hanger.

This makes it possible to stretch the work during plate processing. Therefore, quality of plate processing can be improved and dropout or damages of a work caused by unnecessarily stretching the work can be protected.

(3) The surface treating apparatus or the plating tank of this invention is characterized in that the transport hanger further includes a frame-body member that connects the upper gripper and the lower gripper to form a frame body.

This prevents the plate-like work from receiving an excessive load from the lower clamp that grips the lower end of the plate-like work.

(4) The surface treating apparatus or the plating tank of this invention is characterized in that the frame-body member of the transport hanger is integrally coupled to the upper gripper, and the lower gripper of the transport hanger is adapted to be movable relative to the frame-body member.

This makes it possible to give tension to the plate-like work by the lower clamp of the transport hanger moving relative to the upper clamp coupled to the frame-body member when an attractive force is generated against the lower guide rail.

(5) The surface treating apparatus or the plating tank of this invention is characterized in that the frame-body member of the transport hanger is integrally coupled to the lower gripper, and the upper gripper of the transport hanger is adapted to be movable relative to the frame-body member.

This makes it possible to give tension to the plate-like work by the lower clamp coupled to the frame-body member of the transport hanger moving relative to the upper clamp when an attractive force is generated against the lower guide rail.

(6) The surface treating apparatus or the plating tank of this invention is characterized in that the processing object receives a load from the lower gripper via an elastic member and is balanced at a predetermined position to have no tension before an attractive force is generated between the lower guide rail and the lower gripper of the transport hanger, and the lower gripper of the transport hanger stretches relative to the upper gripper against the force of the elastic member to make the processing object in stretched state after an attractive force is generated between the lower guide rail and the lower gripper of the transport hanger.

This makes it possible to stretch the transport hanger via a spring, thereby not only absorbing the impact on the plate-like work during transportation, but also securing margin of stretching while an attractive force is generated and absorbing the impact at stretching out.

(7) The surface treating apparatus or the plating tank of this invention is characterized in that the transport hanger includes a lower fixing member for fixing a plurality of the lower grippers and a hollow is provided inside the lower fixing member.

This allows the lower fixing member to generate buoyancy while being soaked in the plating solution in the plating tank, thereby absorbing the impact when an attractive force is generated against the fixed guide rail.

(8) The surface treating apparatus or the plating tank of this invention is characterized in that a ferromagnetic material is provided in the lower gripper of the transport hanger, a lower guide rail as the member that generates an attractive force against the lower gripper of the transport hanger is provided at a predetermined position in the tank body, and a hard magnetic material is provided in the lower guide rail along the moving direction.

This makes it possible to generate an attractive force against the fixed guide rail and prevent the transport hanger from sticking to the metallic part which is composing the surface treating apparatus since no magnet is used on the transport hanger.

(9) The surface treating apparatus or the plating tank of this invention is characterized in that a guide groove extending in the direction of transportation is provided on the lower guide rail, and the hard magnetic material is placed on the bottom of the guide groove.

This makes it possible to guide the lower part of the transport hanger along the guide groove in the plating tank.

(10) The surface treating apparatus or the plating tank of this invention is characterized in that the spacing between the upper gripper and the lower gripper can be adjusted by changing the length of the frame-body member corresponding to the length of the processing object, and the vertical position of the lower guide rail can be adjusted corresponding to the length of the processing object.

This makes it possible to perform plate processing on printed circuit boards of various sizes in stretched state.

(11) The surface treating apparatus or the plating tank of this invention is characterized in that at least the upper gripper out of the upper and lower grippers of the transport hanger is structured to make the current flow path symmetrical between both sides of the processing object.

This allows the amount of passed electricity to be uniform between both sides of the plate-like work, resulting in a uniform plating thickness, thereby improving quality of plating.

(12) The surface treating apparatus or the plating tank of this invention is characterized in that at least the upper gripper of the upper and lower grippers of the transport hanger is formed symmetrical with respect to the processing object, and corresponding parts on each side are made of the same material.

This allows the current flow path to be symmetrical between both sides of the plate-like work via the clamp thereby improving quality of plating.

(13) The surface treating apparatus or the plating tank of this invention is characterized by including a spouter for spouting the plating solution toward the processing object and an electric field restrictor that is interposed between the spouter and the processing object and has multiple long holes formed to be oriented to the processing object.

This makes it possible to effectively improve electric field concentration in plate processing while keeping the flow rate constant, thereby improving quality of plating.

(14) The surface treating apparatus or the plating tank of this invention is characterized in that a long hole at a part to which the plating solution is spouted from the spouter is formed smaller than a long hole at a part which is not hit by the spouted plating solution.

This makes it possible to effectively improve electric field concentration in plate processing while improving unevenness of the flow rate of the plating solution near the printed circuit board, thereby improving quality of plating.

(15) The surface treating apparatus or the plating tank of this invention is characterized in that the electric field restrictor is notched following the shape of the upper gripper of the transport hanger.

This makes it possible to effectively improve electric field concentration near the clamp that grips the plate-like work, thereby improving quality of plating.

(16) The surface treating apparatus or the plating tank of this invention is characterized by including an electric field restrictor that is interposed between the spouter and the processing object and has multiple long holes formed to be oriented to the processing object and two conductive porous plates that sandwich the electric field restrictor therebetween and are electrically connected with each other.

This further effectively improves electric field concentration in plate processing, thereby improving quality of plating.

It would be understood that other objects, uses and effects of the invention are obvious to those skilled in the art with reference to the drawings and descriptions below.

BRIEF DESCRIPTION OF THE DRAWINGS

FIG. 25 are views that illustrate a structure of a conventional transport hanger 150 in which

DETAILED DESCRIPTION OF DESIRED EMBODIMENTS

1. Structure of Surface Treating Apparatus 300

Figure 1:
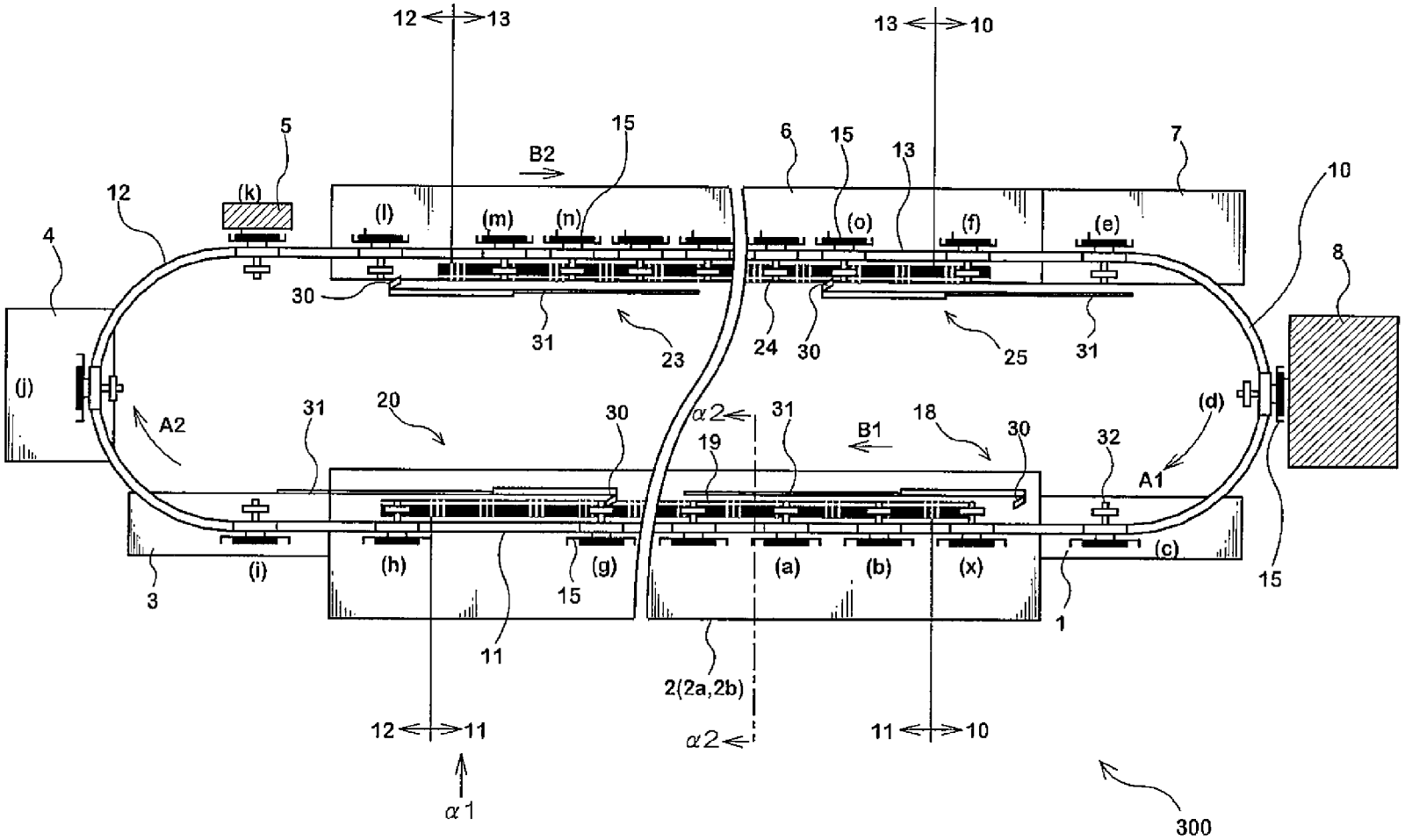
FIG. 1 is a plan view of a surface treating apparatus 300 seen from above.
Figure 2:
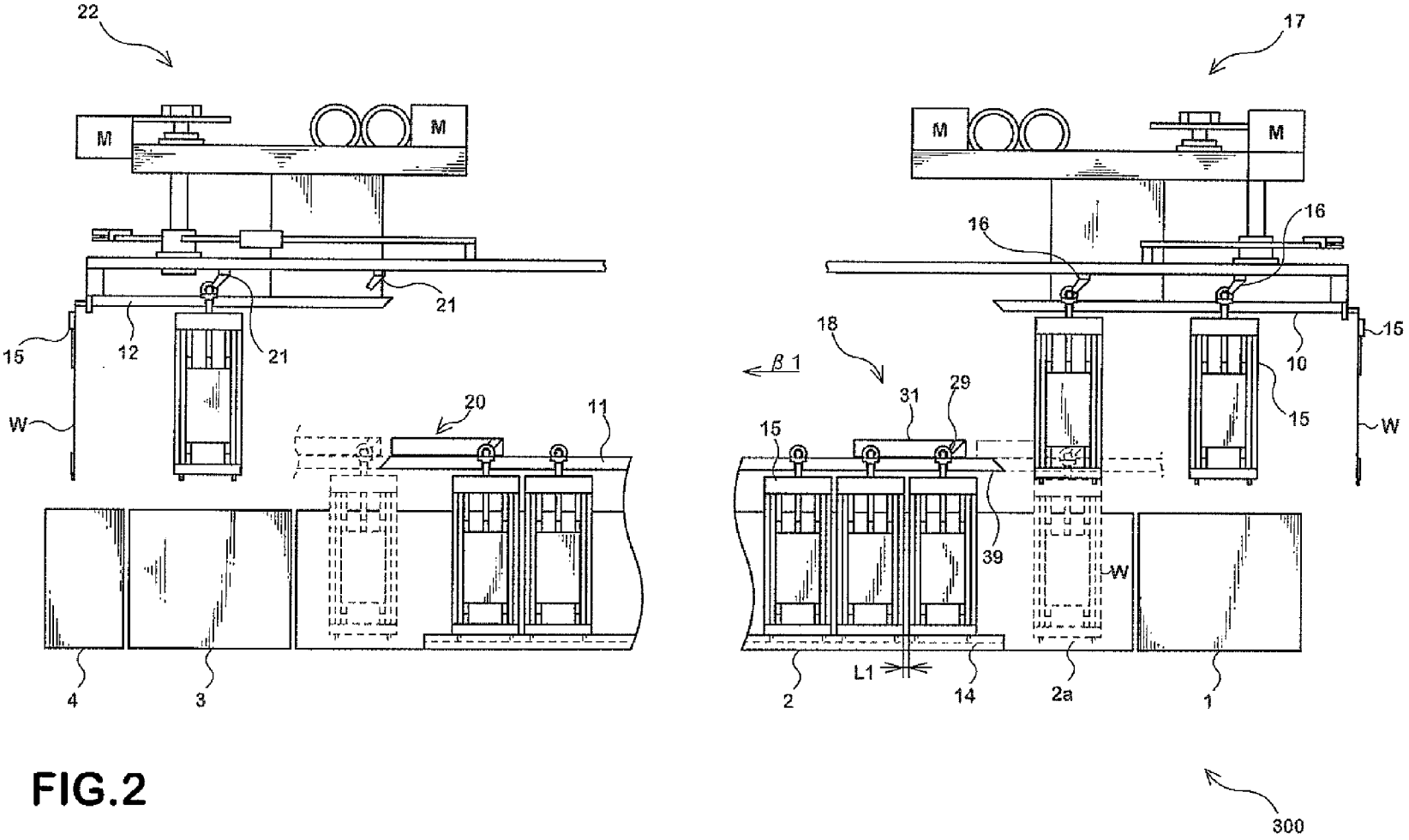
FIG. 2 is a side view of the surface treating apparatus 300 seen from the α1 direction shown in FIG. 1.

A surface treating apparatus 300 for performing plate processing will be described with reference to FIGS. 1 and 2. FIG. 1 is a plan view of a surface treating apparatus 300 seen from above. FIG. 2 is a side view of the surface treating apparatus 300 seen from the α1 direction shown in FIG. 1.

As shown in FIGS. 1 and 2, the surface treating apparatus 300 is a so-called pusher type plating apparatus. As shown in FIG. 1, the surface treating apparatus 300 includes fixed guide rails 11, 13 that are linear and have a fixed height and rise-and-fall guide rails 10, 12 that are U-shaped and capable of moving up and down. The fixed guide rails 11, 13 and the rise-and-fall guide rails 10, 12 respectively have transport hangers 15 attached movably in the direction of arrows A1, A2 and in the direction of arrows B1, B2, as shown in FIG. 1, respectively to support a processing object or plate-like work W (e.g. printed circuit board) which is a target for plating.

At a load section 8 shown in FIG. 1, the transport hanger 15 is loaded with the plate-like work W while the rise-and-fall guide rail 10 is in a lowered state. The transport hanger 15 loaded with the plate-like work W rises following the rise-and-fall guide rail 10, then moves in the direction of arrow A1 driven by an intermittent transporter 17 (FIG. 23) shown in FIG. 2, and transports the plate-like work W to a position above a pre-treatment tank 1 (see (c) in FIG. 1). In this state, the rise-and-fall guide rail 10 falls to cause the plate-like work W to be soaked in the pre-treatment tank 1 for pre-treatment.

Figure 23:
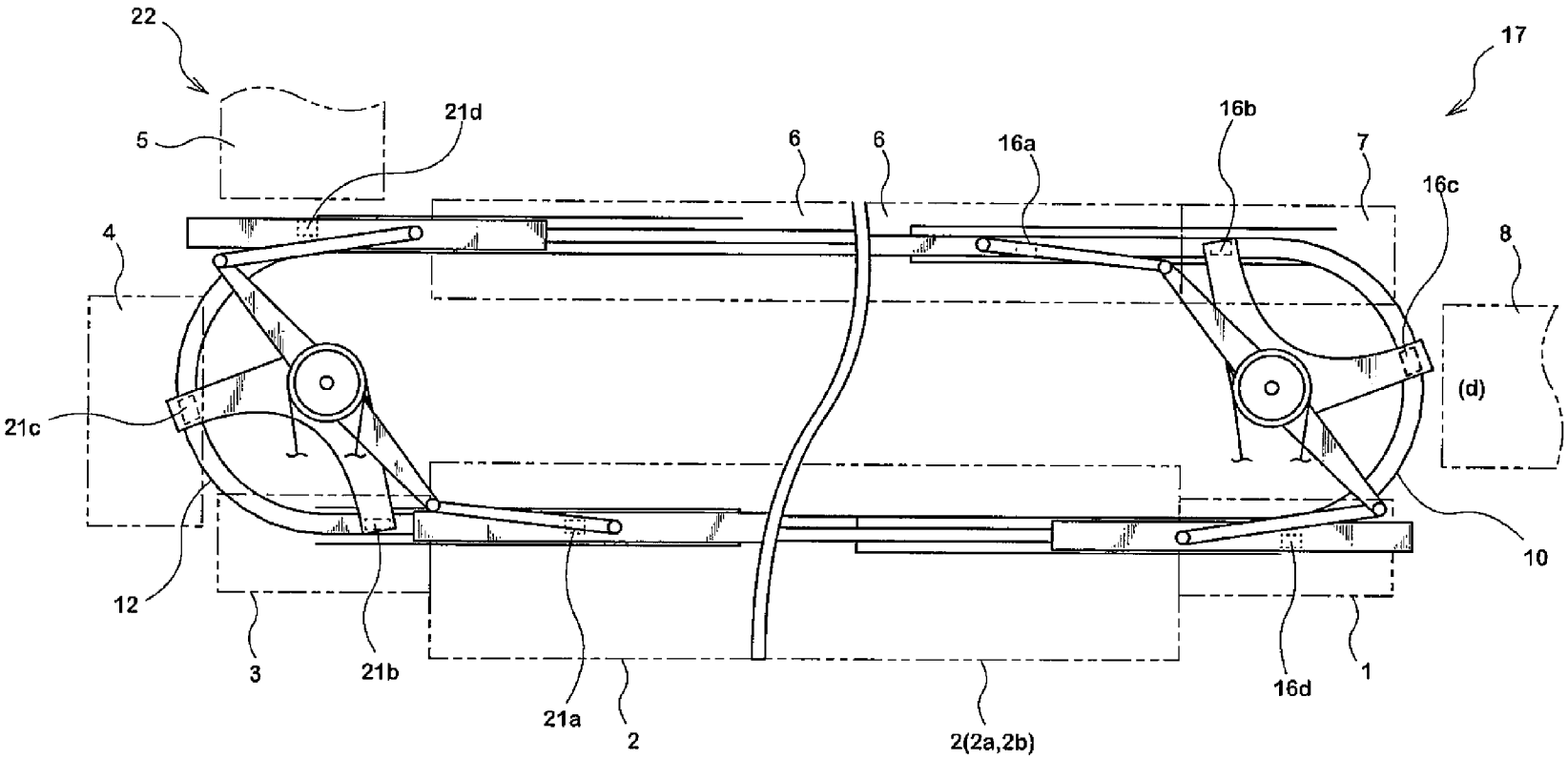
FIG. 23 is a plan view that illustrates a structure of an intermittent transporter provided above a rise-and-fall guide rail.

After the pre-treatment, the rise-and-fall guide rail 10 rises again to cause the plate-like work W supported by the transport hanger 15 to be moved further in the direction of arrow A1 driven by the intermittent transporter 17 (FIG. 23). Thus, the plate-like work W is transported to a position above a plating tank 2 (see a lowered position (x) in FIG. 1).

In this state, the rise-and-fall guide rail 10 falls to cause the plate-like work W together with the transport hanger 15 to be soaked in the plating tank 2. The rise-and-fall guide rail 10 falls to a height same as that of the fixed guide rail 11 as shown in dotted line in FIG. 2. The transport hanger 15 is then transferred to the fixed guide rail 11 from the rise-and-fall guide rail 10 driven by a positioning transporter 18. In this embodiment, the fixed guide rail 11 provided above the plating tank 2 is referred to as an upper guide rail.

Here, the plating tank 2 shown in FIG. 1 corresponds to a first treatment tank in which the plate-like work W is required to have solution treatment in a stretched state, while the pre-treatment tank 1, a recovery tank 3 and a water-washing tank 4 correspond to a second treatment tank in which the plate-like work W is not required to have solution treatment in a stretched state.

The transport hanger 15 by which the plate-like work W is supported is caused to move in a linear direction of arrow B1 along the fixed guide rail 11 by a linear transporter 19 (see (b) and (a) in FIG. 1) while being kept to be soaked in the plating tank 2. Moved further (see (g) in FIG. 1), the transport hanger 15, driven by a letting-off transporter 20, is transferred to another rise-and-fall guide rail 12 in a lowered state (see a lifted position (h) in FIG. 1). In this state, the rise-and-fall guide rail 12 rises and the plate-like work W which has completed plating is taken out from the plating tank 2.

Then the transport hanger 15, driven by an intermittent transporter 22 shown in FIG. 2 (FIG. 23), is moved in the direction of arrow A2 so as to be positioned above the recovery tank 3. In this state, the rise-and-fall guide rail 12 falls to cause the plate-like work W to be soaked in the recovery tank 3.

Then, the rise-and-fall guide rail 12 rises to cause the plate-like work W supported by the transport hanger 15 to be moved to a position above the water-washing tank 4 driven by the intermittent transporter 22 (see a lowered position (j) in FIG. 1). In this state, the rise-and-fall guide rail 12 falls to cause the plate-like work W to be soaked in the water-washing tank 4 and washed with water after the plate processing.

Further, at an unload section 5 shown in FIG. 1, the plate-like work W is unloaded from the transport hanger 15 while the rise-and-fall guide rail 12 is in a lowered state. After unloading of the plate-like work W, the transport hanger 15 is moved forward driven by the intermittent transporter 22 (see (1) in FIG. 1). In this state, the rise-and-fall guide rail 12 falls to cause the transport hanger 15 to be soaked in a processing solution in a strip tank 6.

In the strip tank 6, plated matter attached to the transport hanger 15 is removed by the action of stripping solution. The rise-and-fall guide rail 12 falls to a height same as that of the fixed guide rail 13 as shown in dotted line in FIG. 2. The transport hanger 15 is then transferred to the fixed guide rail 13 from the rise-and-fall guide rail 12 driven by a positioning transporter 31.

The transport hanger 15 in the strip tank 6 is caused to move in a linear direction of arrow B2 along the fixed guide rail 13 by a linear transporter 24 (see (m) and (n) in FIG. 1) while being kept to be soaked in the strip tank 6. Moved further (see (o) in FIG. 1), the transport hanger 15, driven by a letting-off transporter 25, is transferred to the rise-and-fall guide rail 10 in a lowered state (see a lifted position (f) in FIG. 1). In this state, the rise-and-fall guide rail 10 rises and the transport hanger 15 which has completed stripping is taken out from the strip tank 6. The transport hanger 15, driven by the intermittent transporter 17 (FIG. 23), is further transported to a position above a water-washing tank 7 (see (e) in FIG. 1).

In this state, the rise-and-fall guide rail 10 falls to cause the transport hanger 15 to be soaked in the water-washing tank 7 and washed with water after the stripping process. After the water washing, the transport hanger 15 is to be loaded again with another plate-like work W at the load section 8.

Plate processing using the transport hanger 15 on the surface treating apparatus 300 is repeated according to a cycle of stages as described above.

In the present invention, the plate-like work W is not stretched in consideration of possible dropout or damages at any other position than that where the plate-like work W is stretched by pulling the transport hanger 15 downward with an attractive force generated by a lower guide rail 14 provided on a bottom part of the plating tank 2 (FIG. 3) only while performing plate processing on the plate-like work W in the plating tank 2.

Specific structure of the plating tank 2 and the transport hanger 15 and so on used for achieving the aforementioned objective will be described below.

2. Structure of Plating Tank 2*a* and Transport Hanger 15*a*

Figure 3:
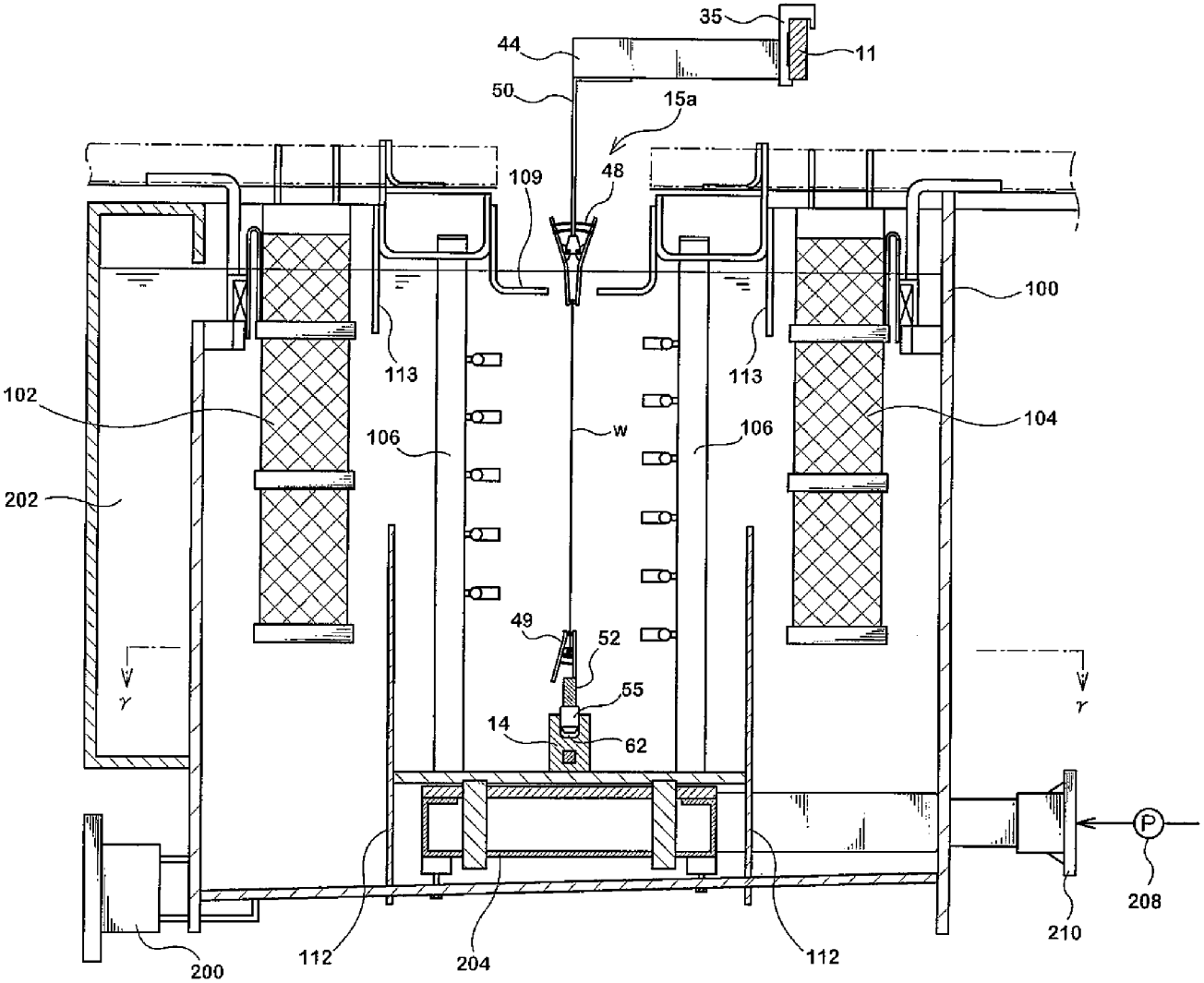
FIG. 3 is a cross-sectional view of a plating tank 2*a* taken along the line α2-α2 in FIG. 1.

FIG. 3 is a cross-sectional view of a plating tank 2*a* of the present invention taken along the line α2-α2 in FIG. 1. A tank body 100 incorporated in the plating tank 2*a* shown in FIG. 3 is filled with a plating solution at a predetermined level.

An upper end of the plate-like work W to be plated in the tank body 100 is gripped by an upper clamp 48 as an upper gripper of the transport hanger 15*a*. A lower end of the plate-like work W is gripped by a lower clamp 49 as a lower gripper of the transport hanger 15*a*. The lower clamp 49 of the transport hanger 15*a* is adapted to be movable relative to the upper clamp 48. The transport hanger 15*a* is to be moved in the tank body 100 driven by a transport mechanism which is described later in such a state that an attractive force is generated between the lower clamp 49 and the lower guide rail 14 (i.e. a state that the plate-like work W is stretched).

In the tank body 100, there are provided anodes (soluble anodes) 102, 104 that supply metal ion to be plated, a spouter 106 that spouts a plating solution toward the plate-like work W, interceptors 109, 112, 113 that intercept an electric current so as not to concentrate an electric current at the ends of the plate-like work W, and so on. In the plating tank 2 shown in FIG. 3, plate processing can be made on the plate-like work W by passing an electric current between the anodes 102, 104 and the plate-like work W.

[Structure of Lower-Section Movable Type Transport Hanger 15*a*]

Figure 4:
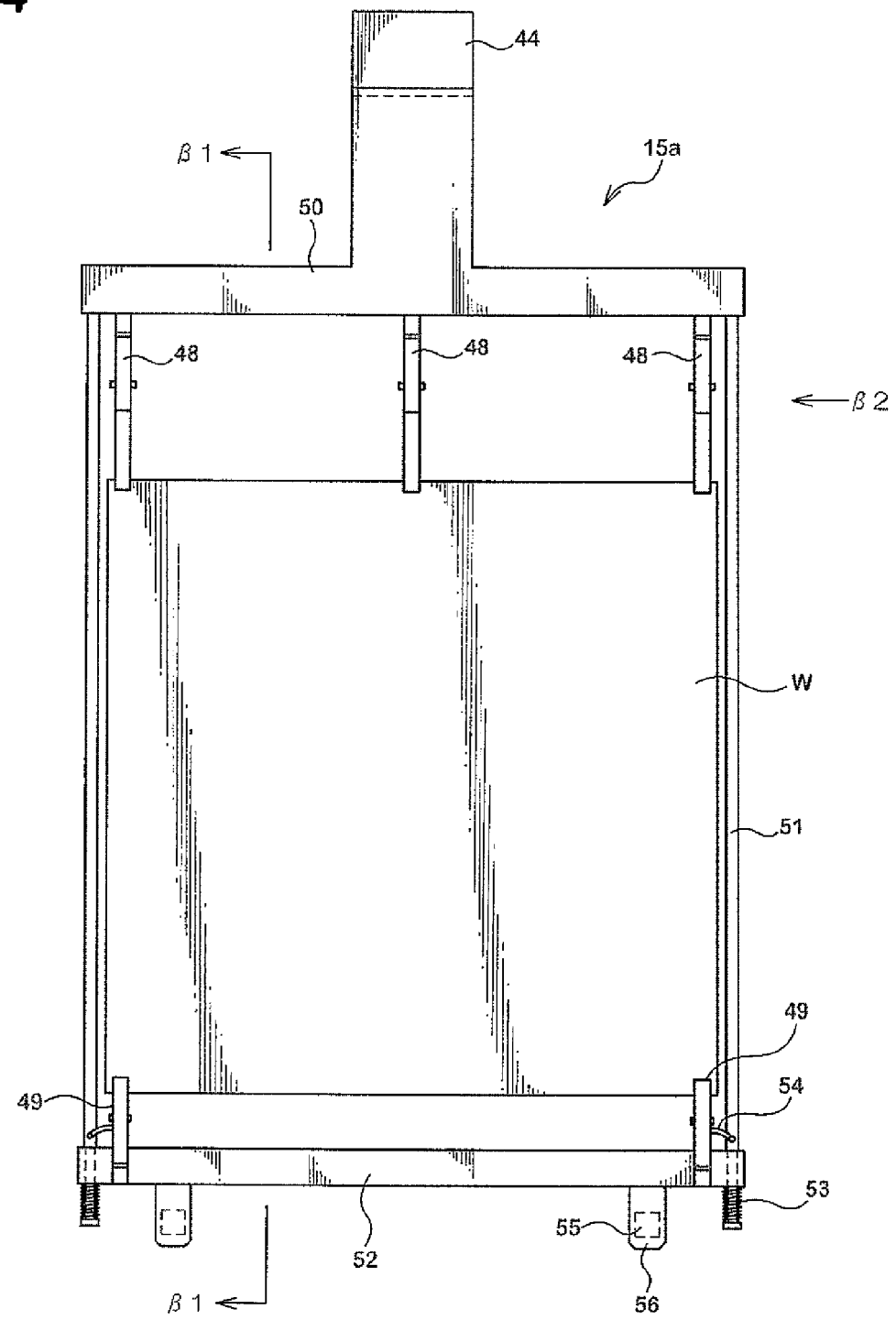
FIG. 4 is a front elevation view that illustrates a structure of a transport hanger 15*a* (lower-section movable type)
Figure 5B:
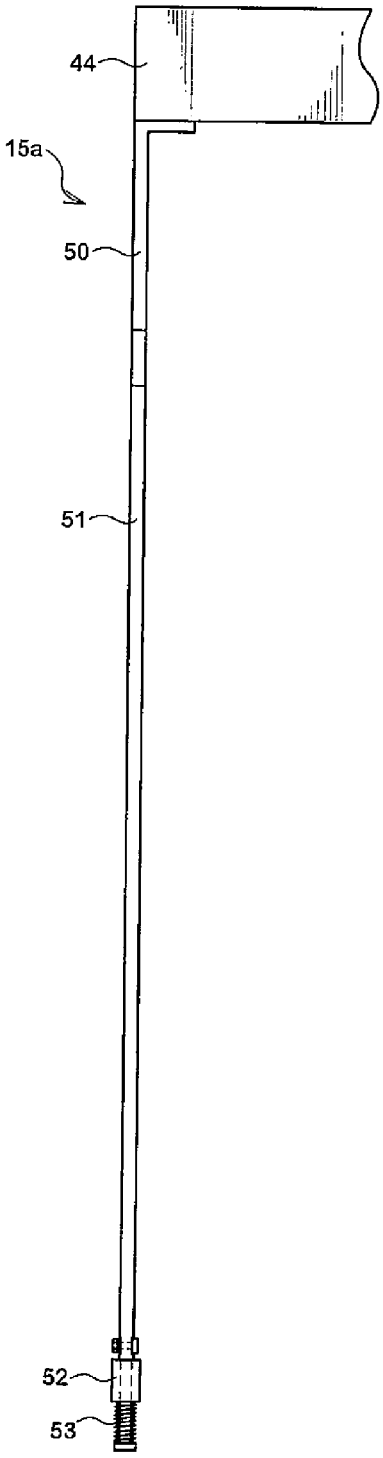
FIG. 5 are a cross-sectional view (FIG. 5A) taken along the line β1-β1 and a side view (FIG. 5B) seen from the β2 direction of the transport hanger 15*a* (lower-section movable type)
Figure 5A:
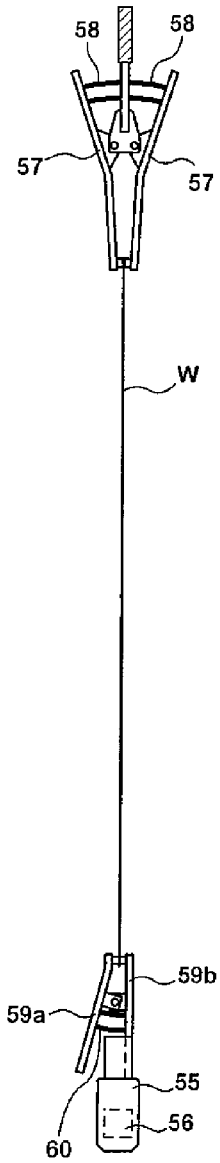

First, the structure of the transport hanger 15*a* shown in FIG. 3 will be described with reference to FIGS. 4 and 5. In this embodiment, the case where the work size is 500×500 (mm) and the thickness of the work is 1 mm or smaller is described as an example. FIG. 4 is a front elevation view that illustrates a structure of the transport hanger 15*a* (lower-section movable type). FIG. 5 are a cross-sectional view (FIG. 5A) taken along the line β1-β1 and a side view (FIG. 5B) seen from the β2 direction of the transport hanger 15*a* (lower-section movable type).

As shown in FIG. 4, the transport hanger 15*a* includes a plurality of upper clamps 48 for gripping an upper end of a processing object W. These upper clamps 48 are fixed to an upper fixing member 50. The upper fixing member 50 is coupled to a slide member 35 (FIG. 3) that slidably contacts the upper guide rail 11 or the like via a connecting member 44 shown in FIG. 5B of side view. At both ends of the upper fixing member 50, frame-body members 51 extending downward are fixed. These frame-body members 51 connect the upper clamp 48 and the lower clamp 49, thereby forming a frame-body. The frame-body member 51 is formed in the shape of a column.

The transport hanger 15*a* further includes a plurality of lower clamps 49 for gripping a lower end of the processing object W. These lower clamps 49 are fixed to a lower fixing member 52. On a lower surface of the lower fixing member 52, two guide bars 55 engaged along a groove (guide groove 62 shown in FIG. 3) that is provided on the lower guide rail 14 are provided. In both ends of the lower fixing member 52, a round hole through which a lower end of the frame-body member 51 fixed to the upper fixing member 50 slides is provided. A metallic piece 56 for generating an attractive force against the lower guide rail 14 is contained inside the guide bar 55.

As described above, the frame-body members 51 of the transport hanger 15*a* are integrally coupled to the upper clamps 48, thereby creating a structure in which the lower clamps 49 of the transport hanger 15*a* can move relative to the frame-body members 51 (and the upper clamps 48).

As a material for the upper fixing member 50, conductive metals such as stainless steel are used. As a material for the frame-body members 51, conductive metals such as stainless steel are also used. However, some part of the frame-body members 51 that slidably contacts the holes provided in both ends of the lower fixing member 52 is coated with resin such as PVC to slide smoothly. As a material for the lower fixing member 52, resin such as PVC is used. As a material for the guide bar 55, low-frictional resin (PP, UHMWPE (Ultra High Molecular Weight Polyethylene), etc.) is used. As a material for the metallic piece 56 of the guide bar 55, a ferromagnetic material (iron, cobalt, nickel, etc.) is used.

At a lower end of the frame-body member 51 of the transport hanger 15*a*, a spring 53 for supporting a load such as the lower fixing member 52 is provided. Further, a lead wire 54 is connected between the frame-body member 51 and the lower clamp 49, making it possible to energize the lower clamp 49 via the frame-body member 51.

As described above, the frame-body member 51 is provided to the transport hanger 15*a*. This prevents the plate-like work W from receiving excessive load from the lower clamp 49 that grips the lower end thereof.

[Double Clamp Structure]

As shown in FIG. 5A, each of the upper clamps 48 is composed of two movable members 57 that are attached in such a manner that they can open and close with respect to the upper fixing member 50 and two springs 58 that urge tips of the movable members in a direction of closing (double clamp structure). These components are formed of steel conductive materials.

As shown in FIG. 5A, the upper clamp 48 is shaped symmetrical with respect to the plate-like work W and corresponding parts are made of the same material. Accordingly, the current flow path can be formed symmetrical between both sides of the plate-like work W (uniformity of electrical resistance can be secured), thereby leveling quality of plate processing (e.g. plating thickness) between the front and back sides of the plate-like work W.

On the other hand, as shown in FIG. 5A, each of the lower clamps 49 is composed of one movable member 59*a* that is attached in such a manner that it can open and close with respect to the lower fixing member 52, a fixed member 59*b* fixed to the lower fixing member 52 and one spring 60 that urges a tip of the movable member 59*a* in a direction of closing (single clamp structure). These components are formed of conductive steel materials.

As described above, only the upper clamp 48 adopts a double clamp structure and the lower clamp 49 adopts a single clamp structure. In this context, as shown in FIG. 3, in the case of the upper clamp 48, approximately half thereof from its tip is soaked in the plating solution, which has a significant effect from unevenness of electric current. On the other hand, the lower clamp 49 is entirely soaked in the plating solution and therefore has a slight effect from unevenness of electric current.

[Structure of Lower Guide Rail 14]

Figure 6:
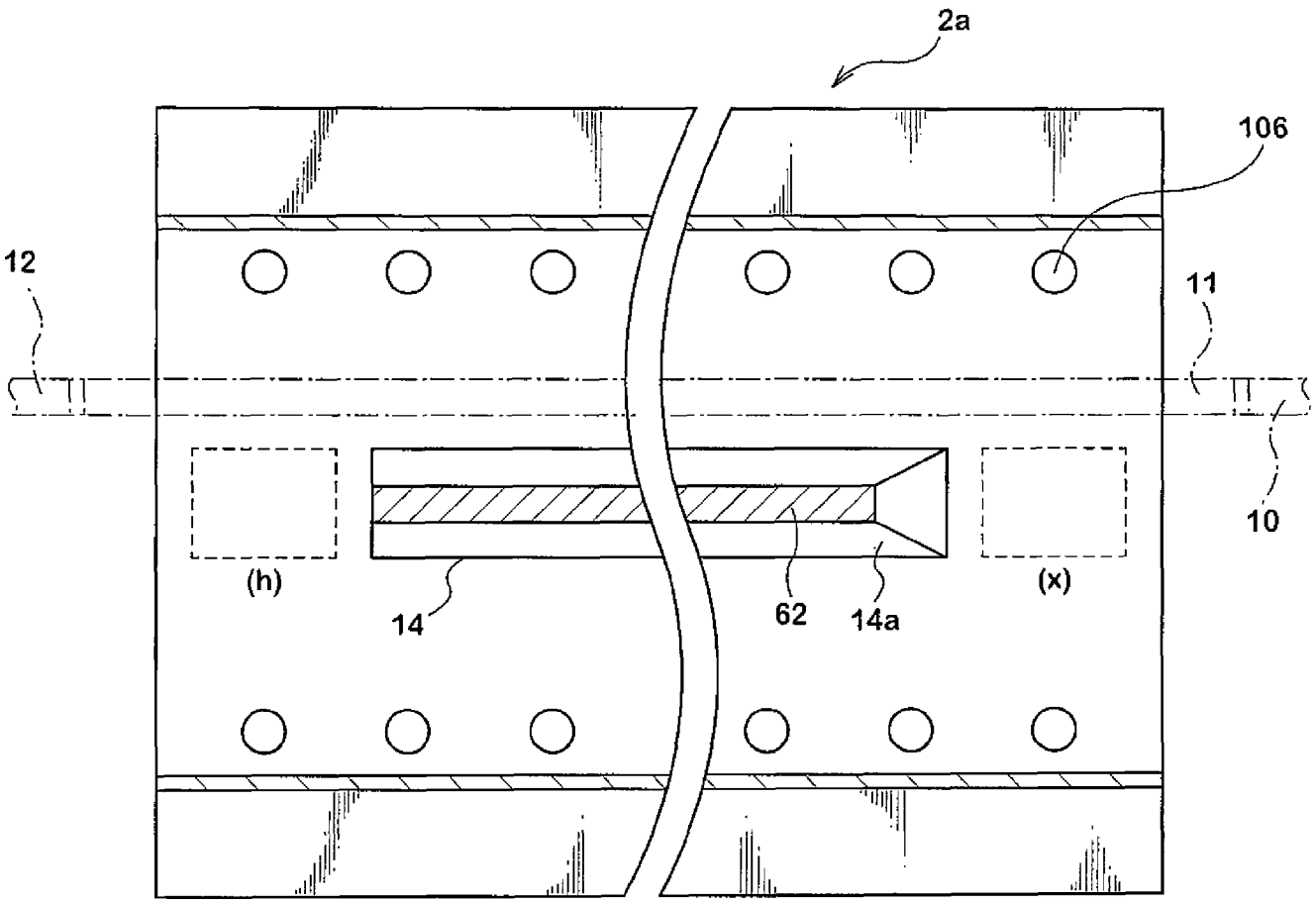
FIG. 6 is a bottom view of the plating tank 2 seen from the γ direction in FIG. 3.
Figure 7:
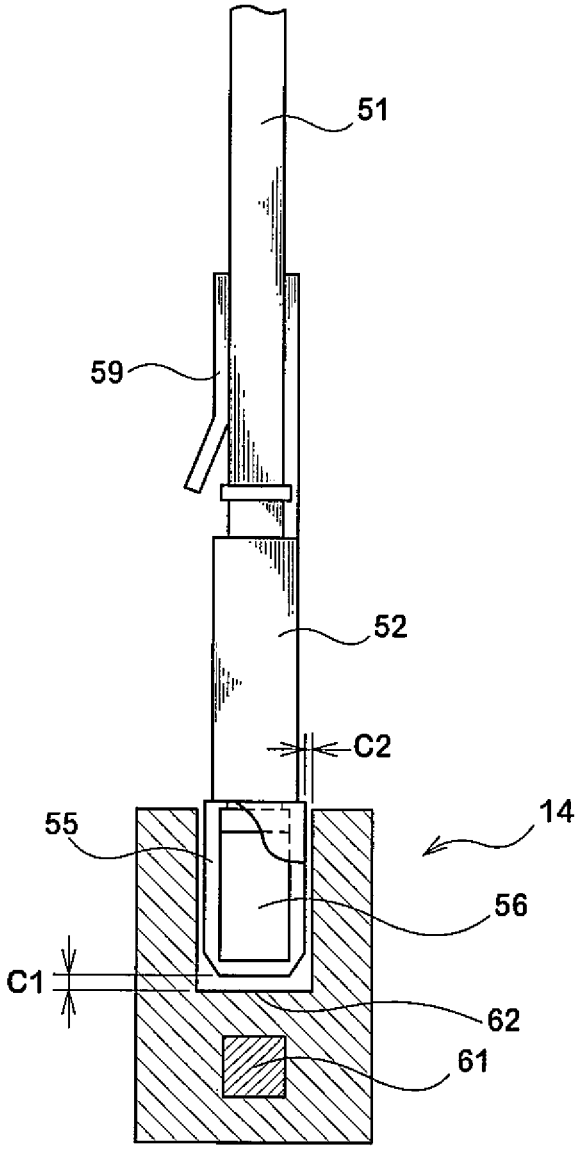
FIG. 7 is a detail view that illustrates a state where a guide bar of the transport hanger 15*a* is introduced into a guide groove 62 of a lower guide rail 14.

The structure of the lower guide rail 14 shown in FIG. 3 will hereinafter be described with reference to FIGS. 6 and 7. FIG. 6 is a bottom view of the plating tank 2*a* (FIG. 3) seen from the γ direction. FIG. 7 is a detail view that illustrates a state where the guide bar 55 of the transport hanger 15*a* is introduced into the guide groove 62 of the lower guide rail 14.

As shown in FIG. 6, the lower guide rail 14 is provided between a soaked position ((x) position in FIG. 1) and a lifted position ((h) position in FIG. 1) in the plating tank 2. In the lower guide rail 14, a guide opening 14*a* is provided in a tapered form to guide the guide bar 55, and the guide groove 62 is provided extending in a direction of transportation along the plate-like work W to be transported. From the position of the tapered bottom shown in FIG. 6 to the end of the guide groove 62, permanent magnets 61 (hard magnetic material) are continuously embedded beneath the bottom of the guide groove 62. Except for the permanent magnets 61, the entire lower guide rail 14 is made of steel.

As shown in FIG. 7, the guide bar 55 and the guide groove 62 are designed such that predetermined spacings are secured respectively between the bottom surface of the guide bar 55 and the bottom surface of the guide groove 62 as well as between the side surfaces of the guide bar 55 and the guide groove 62 while an attractive force is generated. The spacing C1 between the bottom surface of the guide bar 55 and the bottom surface of the guide groove 62 can be set, for example, to 2 mm and the spacing C2 between the side surfaces of the guide bar 55 and the guide groove 62 can be set, for example, to 1 mm.

The electric current from the upper guide rail 11 is supplied to the plate-like work W through the current flow path following the slide member 35, the connecting member 44, the upper fixing member 50, and the clamp 48 (or the clamp 49 via the frame-body member 51).

[Relationship of Forces Before and after Generation of Attractive Force]

Figure 8:
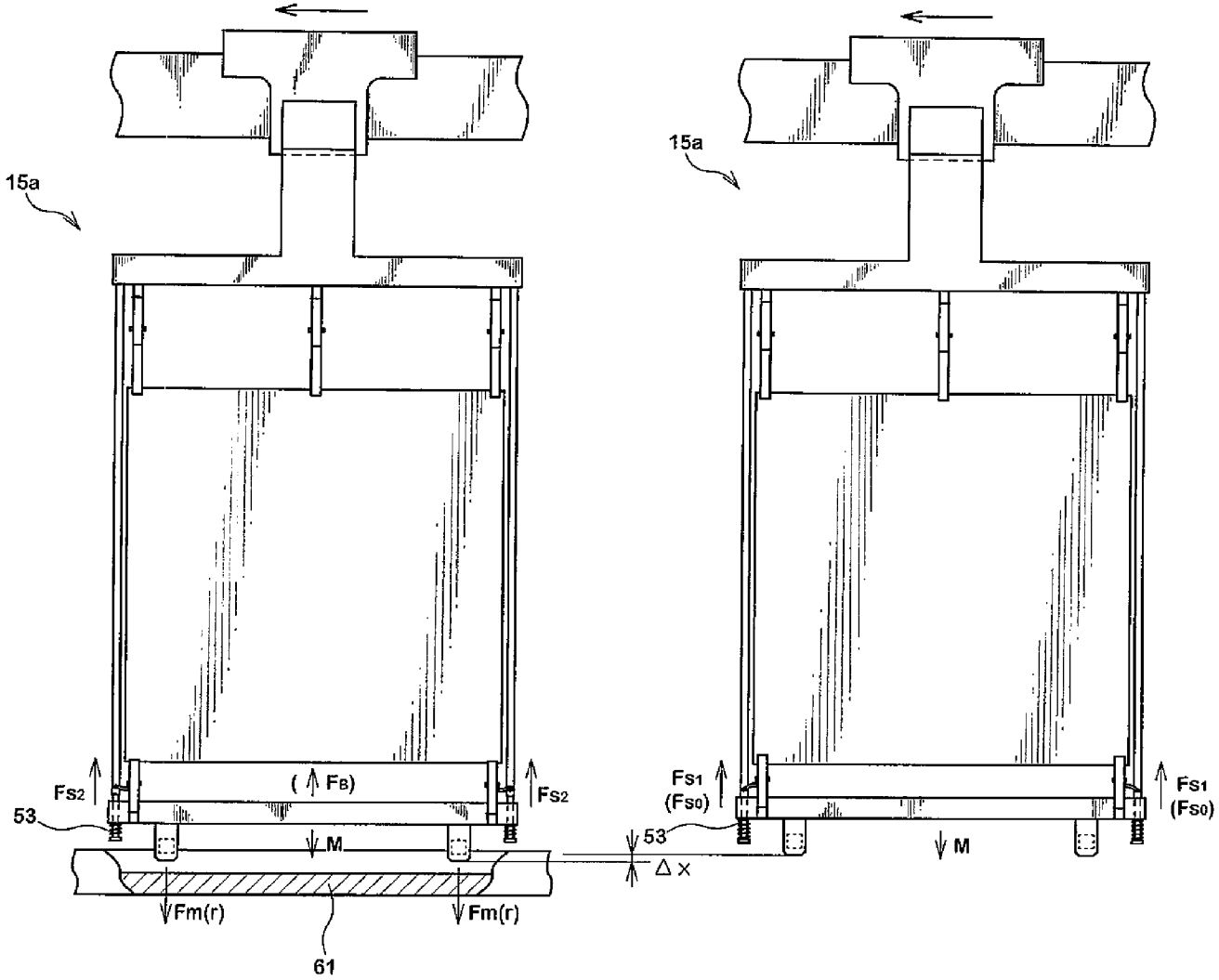
FIG. 8 is a front elevation view that illustrates the relationship of forces acting on the transport hanger 15*a* before and after the transport hanger 15*a* reaches the lower guide rail 14.

Next, the relationship of forces applied on the transport hanger 15*a* and the lower guide rail 14 will be described with reference to FIG. 8. FIG. 8 illustrates the relationship of forces applied on the transport hanger 15*a* before and after the transport hanger 15*a* reaches the lower guide rail 14.

As shown in FIG. 8, before the transport hanger 15*a* lowered into the plating tank 2 reaches the lower guide rail 14, the transport hanger 15*a* receives only a force FS1 of the spring 53 and a lower load M (total weight of the lower clamp 49, the lower fixing member 52, the guide bar 55 etc.) of the transport hanger 15*a* (adequately small buoyancy FB is negligible). Accordingly, equilibrium of forces is represented by an equation [2×FS1=M]. At this time, the shrinkage of spring X1 is obtained as X1=M/2k (k: constant of spring) by substituting the above equation into an equation [FS1=k×X1].

Thus, before an attractive force is generated between the lower guide rail 14 and the lower clamp 49 of the transport hanger 15, the plate-like work W can be made in loosened state (the state where no tension is applied to the plate-like work W) by the spring 53 supporting the lower load. The impact on the plate-like work W during transportation can be absorbed by stretching the transport hanger 15*a* via the spring 53. Further, by the stretching, margin of stretching can be secured after an attractive force is generated, and the impact of taking out can also be absorbed.

On the other hand, when the transport hanger 15*a* lowered into the plating tank 2 reaches the lower guide rail 14, an attractive force Fm(r) is generated between the lower guide rail 14 and the lower gripper 49 of the transport hanger 15*a*. In this state, as shown in FIG. 8, resisting a force FS2 of the spring 53, the lower clamp 49 of the transport hanger moves to extend downward relative to the upper clamp 48, thereby making the plate-like work W in stretched state (the state where some tension is applied to the plate-like work W).

As shown in FIG. 8, after the transport hanger 15*a* reaches the lower guide rail 14, the transport hanger 15*a* further receives an attractive force Fm(r) generated against the lower guide rail 14 in addition to the force FS2 (>FS1) of the spring 53 and the lower load M (total weight of the lower clamp 49, the lower fixing member 52, the guide bar 55 etc.). Accordingly, equilibrium of forces after an attractive force is generated is represented by an equation [2×FS2=M+2×Fm(r)]. Here, the symbol Fm(r) means that a magnetic force Fm varies in magnitude depending on the distance from a center of the permanent magnet 61.

A necessary condition for the plate-like work W to have vertical tension is such that the total of the lower load M and double the attractive force of Fm(r) is larger than an upward force of the spring 53 (2×FS2). That is, when X2 is defined as the shrinkage of the spring relative to the natural length, the attractive force Fm(r) is derived as Fm(r)>k X2−M/2 from an equation [M+2×Fm(r)>2×k X2]. The shrinkage ΔX of the spring 53 shown in FIG. 8 is obtained by subtracting the shrinkage X1 of the spring 53 relative to the natural length in the state where the attractive force Fm(r) is not generated from the shrinkage X2 of the spring 53 relative to the natural length in the state where the attractive force Fm(r) is generated.

[Loading and Unloading of Plate-Like Work W]

Loading and unloading of the plate-like work W to and from the transport hanger 15 will hereinafter be described.

When the plate-like work W is loaded at the load section 8 in FIG. 1, the lower fixing member 52 of the transport hanger 15*a* is slightly pushed up and the upper clamp 48 and the lower clamp 49 (FIG. 4) are opened. In this state, the plate-like work W is lifted up with a PCB installation apparatus (not shown) equipped with a chucking mechanism, an upper end and a lower end of the plate-like work W are respectively inserted into the upper clamp 48 and the lower clamp 49 (FIG. 4), and subsequently both the clamps are closed.

At this time, if the lower fixing member 52 of the transport hanger 15*a* is restored from the pushed-up state, the spring 53 is shrunk by the lower load M shown in FIG. 8. In this state, the length of the frame-body member 51 is preferably adjusted so that the plate-like work W becomes loosened.

When the plate-like work W is unloaded at the unload section 5 in FIG. 1, at first, the upper clamp 48 and the lower clamp 49 (FIG. 4) are opened while the plate-like work W is pinched by the PCB installation apparatus (not shown) equipped with the chucking mechanism. Subsequently, the lower fixing member 52 is slightly pushed down so that the plate-like work W is pulled out to be removed.

3. Second Embodiment

Figure 9:
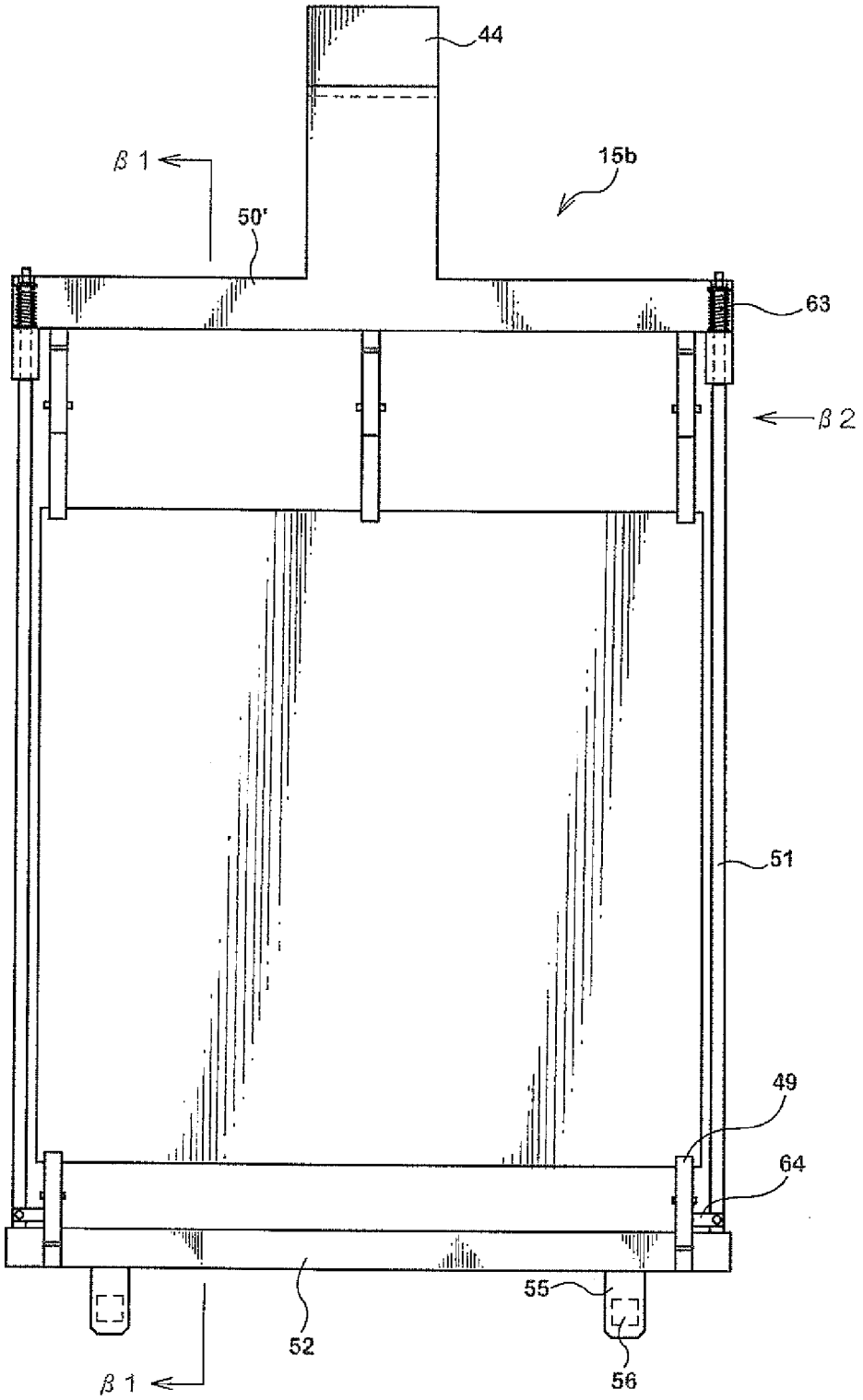
FIG. 9 is a front elevation view that illustrates a structure of a transport hanger 15*b* (upper-section movable type)
Figure 10B:
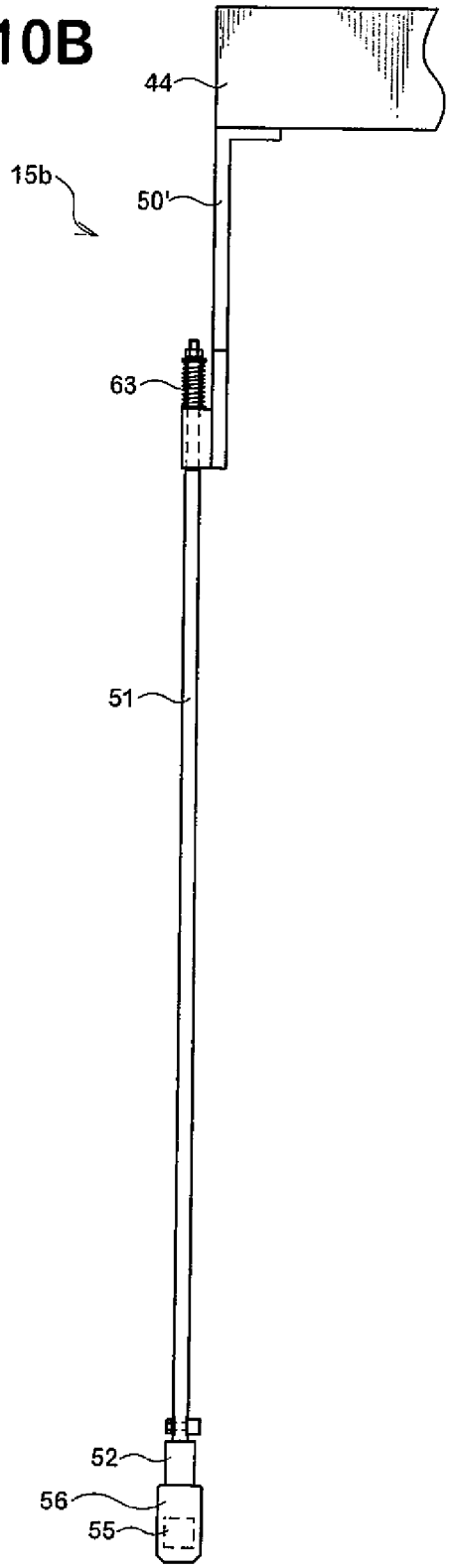
FIG. 10 are a cross-sectional view (FIG. 10A) taken along the line β1-β1 and a side view (FIG. 10B) seen from the β2 direction of the transport hanger 15*b* (upper-section movable type)
Figure 10A:
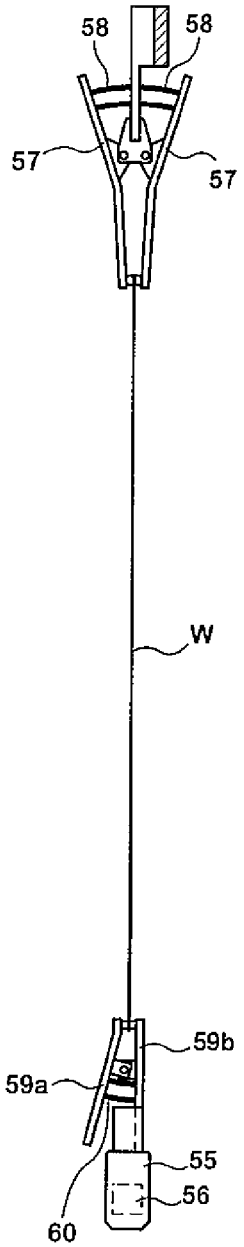

In the aforementioned embodiment, a lower-section movable type transport hanger 15*a* (FIGS. 4 and 5) is described. However, an upper-section movable type transport hanger 15*b* shown in FIGS. 9 and 10 may be employed. Specifically, the frame-body members 51 of the transport hanger 15*b* are integrally coupled to the lower clamps 49, thereby creating a structure in which the upper clamps 48 of the transport hanger 15*b* can move relative to the frame-body members 51 (and the lower clamps 49). FIG. 9 is a view that illustrates a structure of the upper-section movable type transport hanger 15*b*. FIG. 10 are a cross-sectional view (FIG. 10A) taken along the line β1-β1 and a side view (FIG. 10B) seen from the β2 direction of the upper-section movable type transport hanger 15*b* that respectively correspond to FIG. 4 and FIG. 5.

As shown in FIG. 9, the transport hanger 15*b* includes a plurality of upper clamps 48 for gripping an upper end of a processing object W. These upper clamps 48 are fixed to an upper fixing member 50'. The upper fixing member 50' is coupled to the slide member 35 (FIG. 3) that slidably contacts the upper guide rail 11 or the like via the connecting member 44 shown in FIG. 10B of side view. In both ends of the upper fixing member 50', a round hole through which an upper end of the frame-body member 51 fixed to the lower fixing member 52 slides is provided. The upper fixing member 50' has a different shape from the upper fixing member 50 shown in FIG. 5B in order to provide a round hole at a position where an upper end of the frame-body member 51 does not contact the upper fixing member 50'.

The transport hanger 15*b* further includes a plurality of lower clamps 49 for gripping a lower end of the processing object W. These lower clamps 49 are fixed to the lower fixing member 52. On a lower surface of the lower fixing member 52, two guide bars 55 engaged along a groove (guide groove 62 shown in FIG. 3) provided on the lower guide rail 14 are provided. In both ends of the lower fixing member 52, the frame-body members 51 extending upward are fixed. The metallic piece 56 for generating an attractive force against the lower guide rail 14 is contained inside the guide bar 55. The frame-body member 51 is formed in the shape of a column.

As a material for the upper fixing member 50', conductive metals such as stainless steel are used. As a material for the frame-body members 51, conductive metals such as stainless steel are also used. However, some part of the frame-body members 51 that slidably contacts the holes provided in both ends of the upper fixing member 50' is coated with resin such as PVC to slide smoothly. As a material for the lower fixing member 52, resin such as PVC is used. As a material for the guide bar 55, low-frictional resin (PP, UHMVPE (Ultra High Molecular Weight Polyethylene), etc.) is used. As a material for the metallic piece 56 of the guide bar 55, a ferromagnetic material (iron, cobalt, nickel, etc.) is used.

At an upper end of the frame-body member 51 of the transport hanger 15*b*, a spring 63 for supporting a load such as the lower fixing member 52 is provided. Further, an energizing member 64 is connected between the frame-body member 51 and the lower clamp 49, making it possible to energize the lower clamp 49 via the frame-body member 51.

The structure of the upper clamp 48 or the double clamp structure and the structure of the lower guide rail 14 are the same to those shown in FIGS. 5A, 6 and 7.

Figure 11:
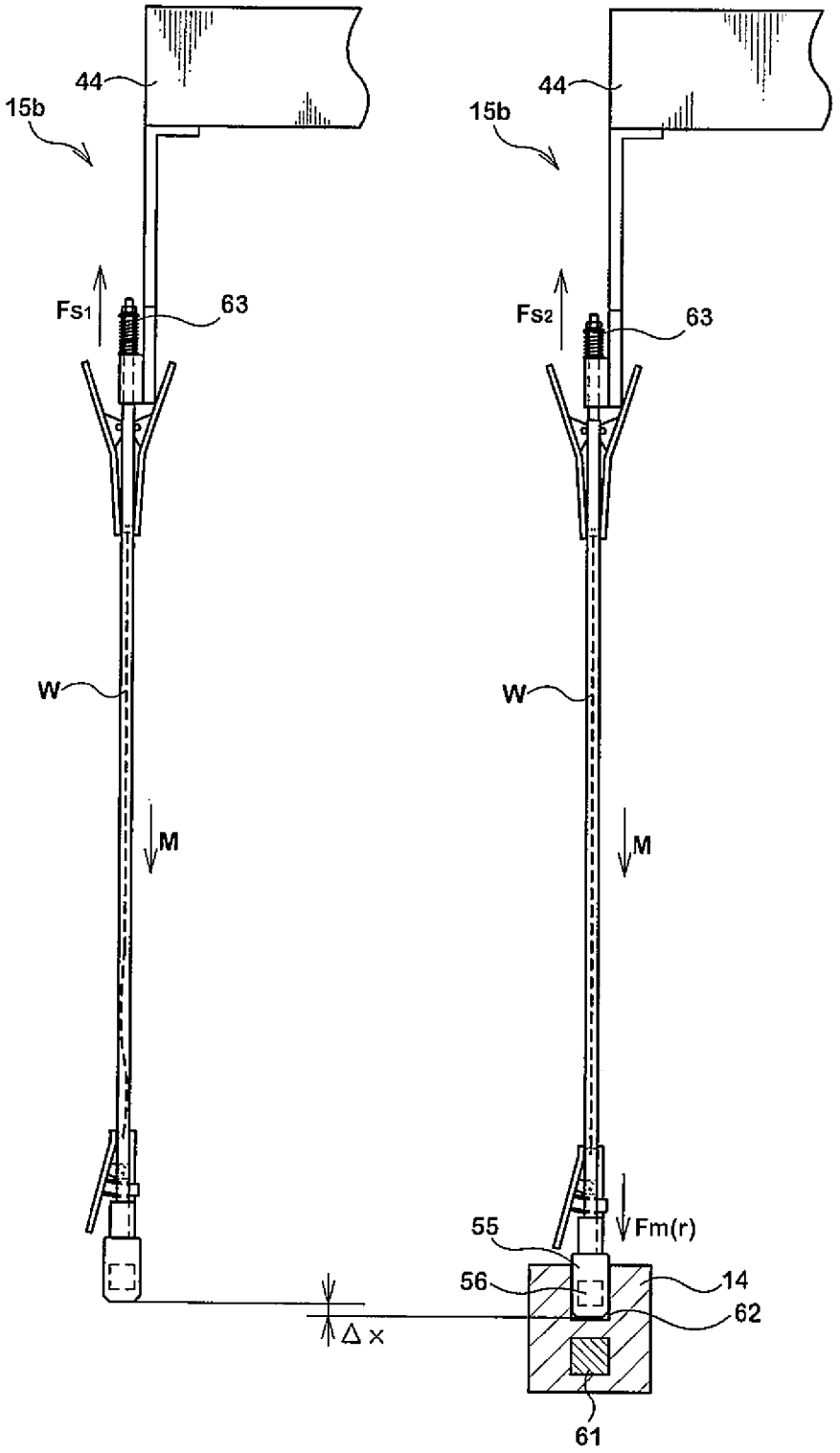
FIG. 11 is a side view that illustrates the relationship of forces acting on the transport hanger 15*b* before and after the transport hanger 15*b* reaches the lower guide rail 14.

Also, the relationship of forces applied on the transport hanger 15*b* and the lower guide rail 14 shown in FIG. 11 is similar as described below.

A necessary condition for the plate-like work W to have vertical tension is such that the total of the lower load M and double the attractive force of Fm(r) is larger than an upward force of the spring 63 (2×FS2). That is, when X3 is defined as the shrinkage of the spring 63 relative to the natural length, the attractive force Fm(r) is derived as Fm(r)>k X3−M/2 from an equation [M+2×Fm(r)>2×k X3]. The shrinkage ΔX of the spring 63 shown in FIG. 11 is obtained by subtracting the shrinkage X1 of the spring 63 relative to the natural length in the state where the attractive force Fm(r) is not generated from the shrinkage X3 of the spring 63 relative to the natural length in the state where the attractive force Fm(r) is generated.

4. Third Embodiment

In the plating tank 2*a* shown in FIG. 3, the sparger 106 that spouts a plating solution toward the plate-like work W is provided. However, as shown in FIG. 12, a plating tank 2*b* may be, in addition to the provision of the sparger 106 that spouts a plating solution toward the plate-like work W, provided with a porous body H as an electric field restrictor including multiple long holes formed to be oriented to the plate-like work W and two conductive porous plates P1, P2 that sandwich the electric field restrictor therebetween and are electrically connected with each other between the sparger 106 and the plate-like work W.

Figure 13:
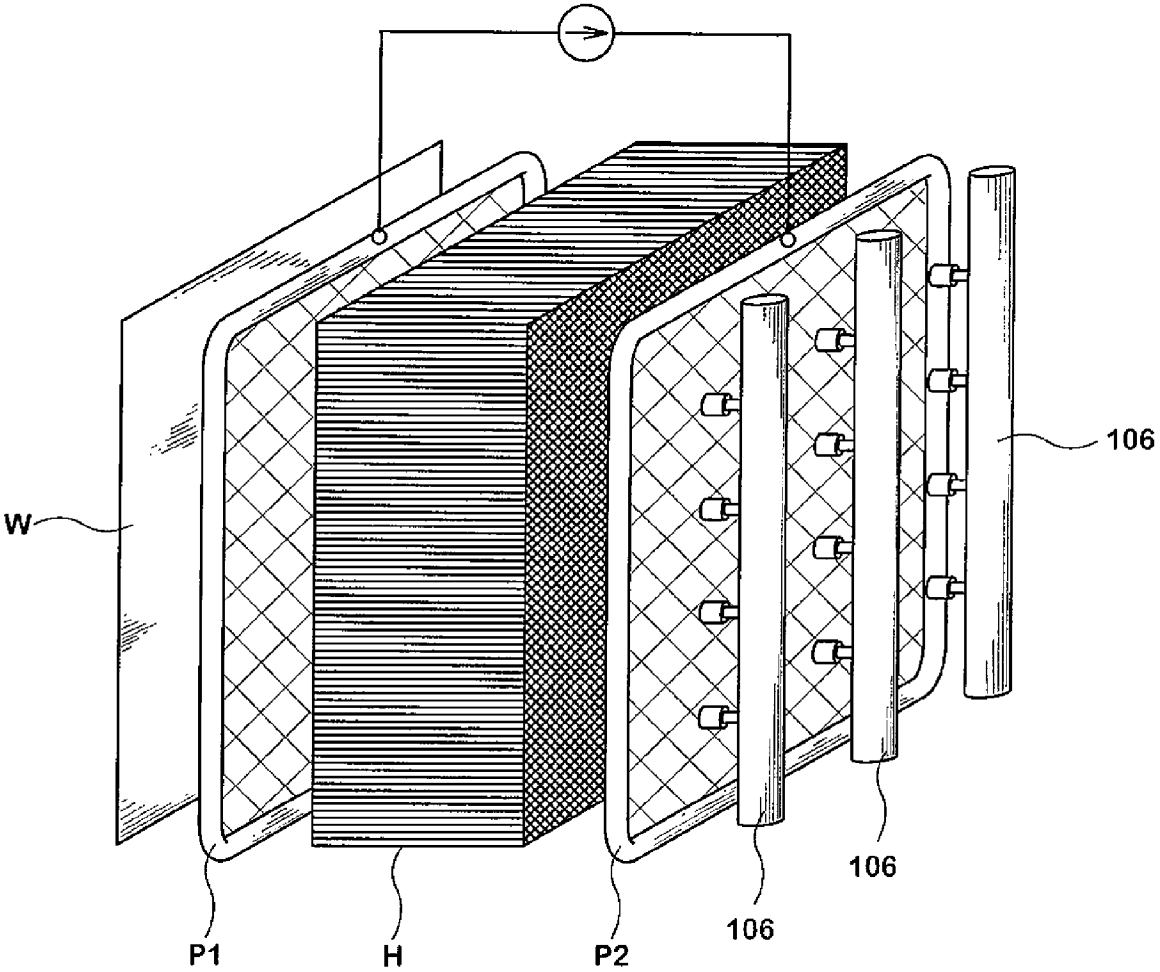
FIG. 13 is a view that illustrates an arrangement of a plate-like work W, a porous body H, two porous electrodes P1 and P2, and a sparger 106.

FIG. 13 is a view that illustrates an arrangement of the plate-like work W, the porous body H, two porous electrodes P1 and P2, and a sparger 106. As shown in FIG. 13, the porous electrode P1, the porous body H, the porous electrode P2, and the sparger 106 are arranged in this order from the plate-like work W. With this arrangement, a structure of cathode (W)-anode (P1)-cathode (P2)-anode (102, 104) can be formed in the order from the plate-like work W to the anode via the porous electrode P1, P2. This arrangement is similar on the opposite side of the plate-like work W.

Figure 12:
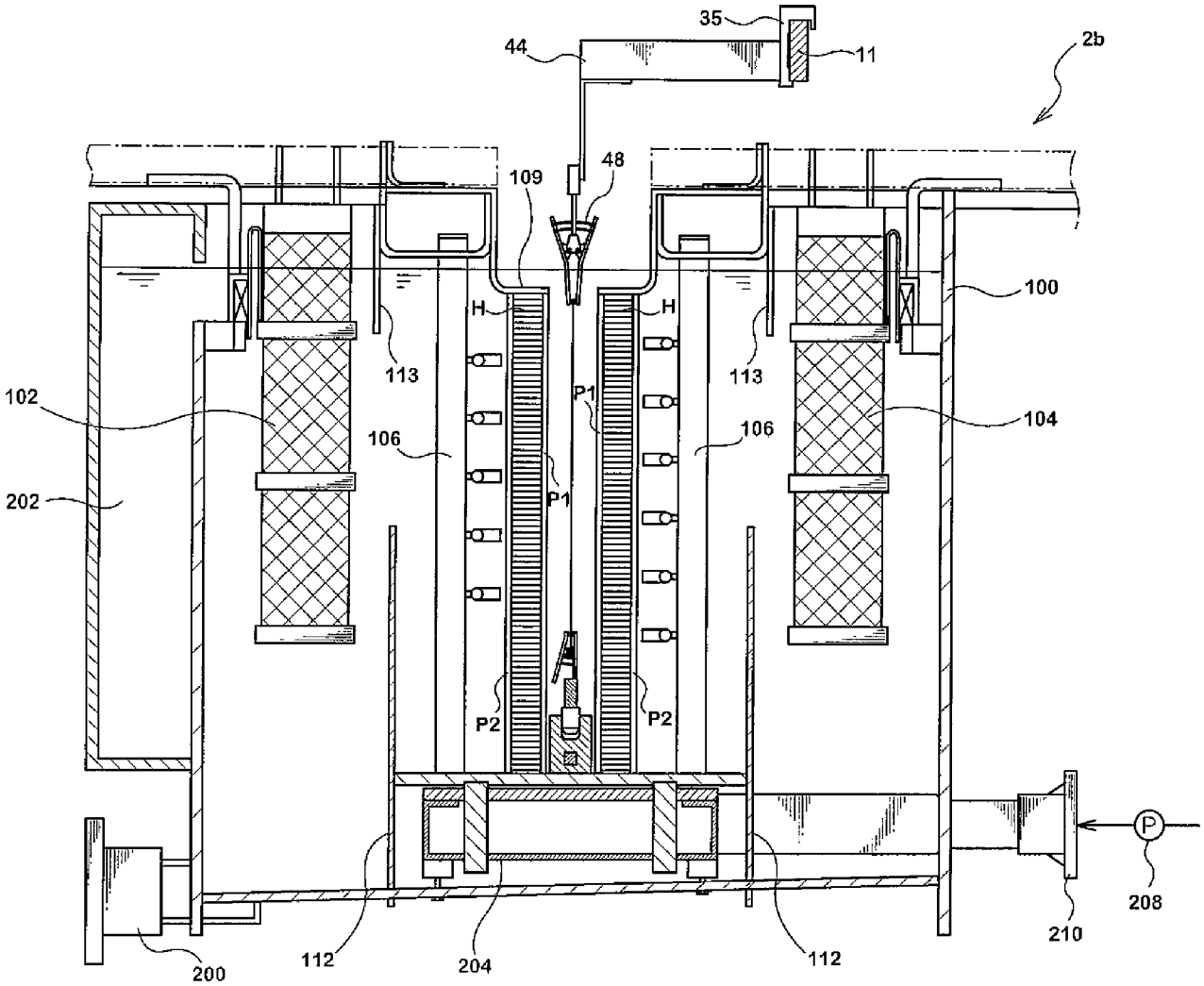
FIG. 12 is a view that illustrates a structure of a plating tank 2*b* according to another embodiment.

As shown in FIG. 12, a pair of spargers 106 are provided in such an arrangement that nozzles of each sparger are alternated across the plate-like work W. The porous electrodes P1, P2 are structured such that a meshed conductive material is attached to a frame formed of conductive steel materials. Installation of the porous electrodes P1, P2 is such that the porous electrode is fixed by fitting into a recess formed in a predetermined location of the plating tank 2*b* and an upper part of the porous electrode is electrically connected by a wire.

The porous body H is produced for example by forming a PVC material with honeycomb long-holes in a desired thickness and continuously arranging formed pieces in a direction of transportation. As the porous body H, a piece with a thickness of a few tens of millimeters and a width across honeycomb flat of a few to 20 millimeters for example can be used. The porous body H is interposed between the porous electrodes P1 and P2.

With the structure as described above, electric field concentration in plate processing can be effectively improved by factors such as the provision of equipotential plane in the vicinity of the plate-like work W by means of the porous electrodes P1, P2.

Figure 14:
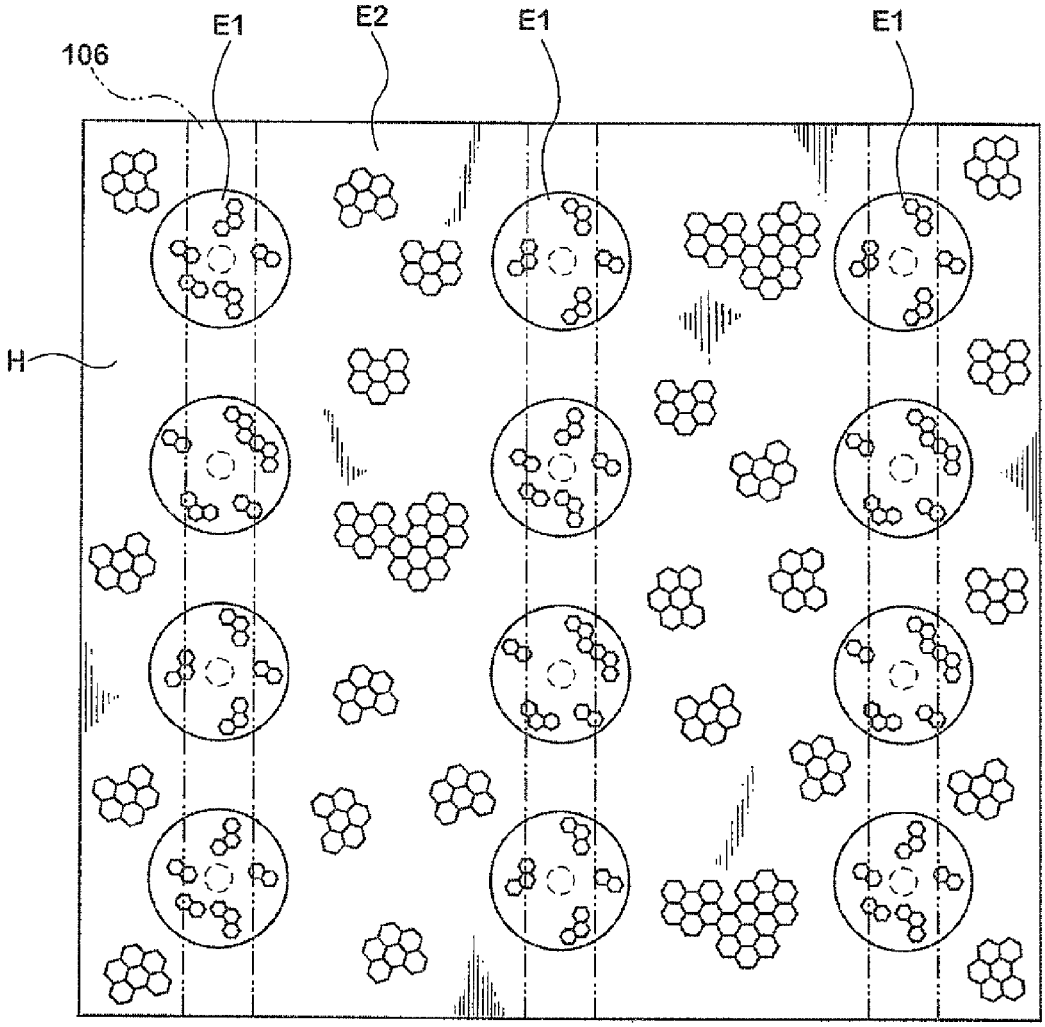
FIG. 14 is a view of a porous body example whose hole size is varied corresponding to the position of the sparger 106.

FIG. 14 is a view of an example of the porous body H whose hole size is varied corresponding to the position of the sparger 106. As shown in FIG. 14, the hole size at a position corresponding to each of nozzles of the sparger 106 or apart E1 at which the spouted plating solution is targeted is made smaller than that at the other part E2. For example, the hole size at a part at which the spouted plating solution is targeted is 3 mm and the hole size at the other part is 13 mm. In particular, the porous body as described above can be formed by such a manner that a porous body with a small hole size corresponding to the part E1 is formed in a column, another larger porous body with a large hole size corresponding to the part E2 is bored by the same size of the column, and the column porous body with a small hole size is fitted into the bored larger porous body with a large hole size.

By setting the hole size as described above, the flow rate of the plating solution near the plate-like work W can be made uniform, thereby improving quality of plating.

5. Other Embodiment

Figure 15:
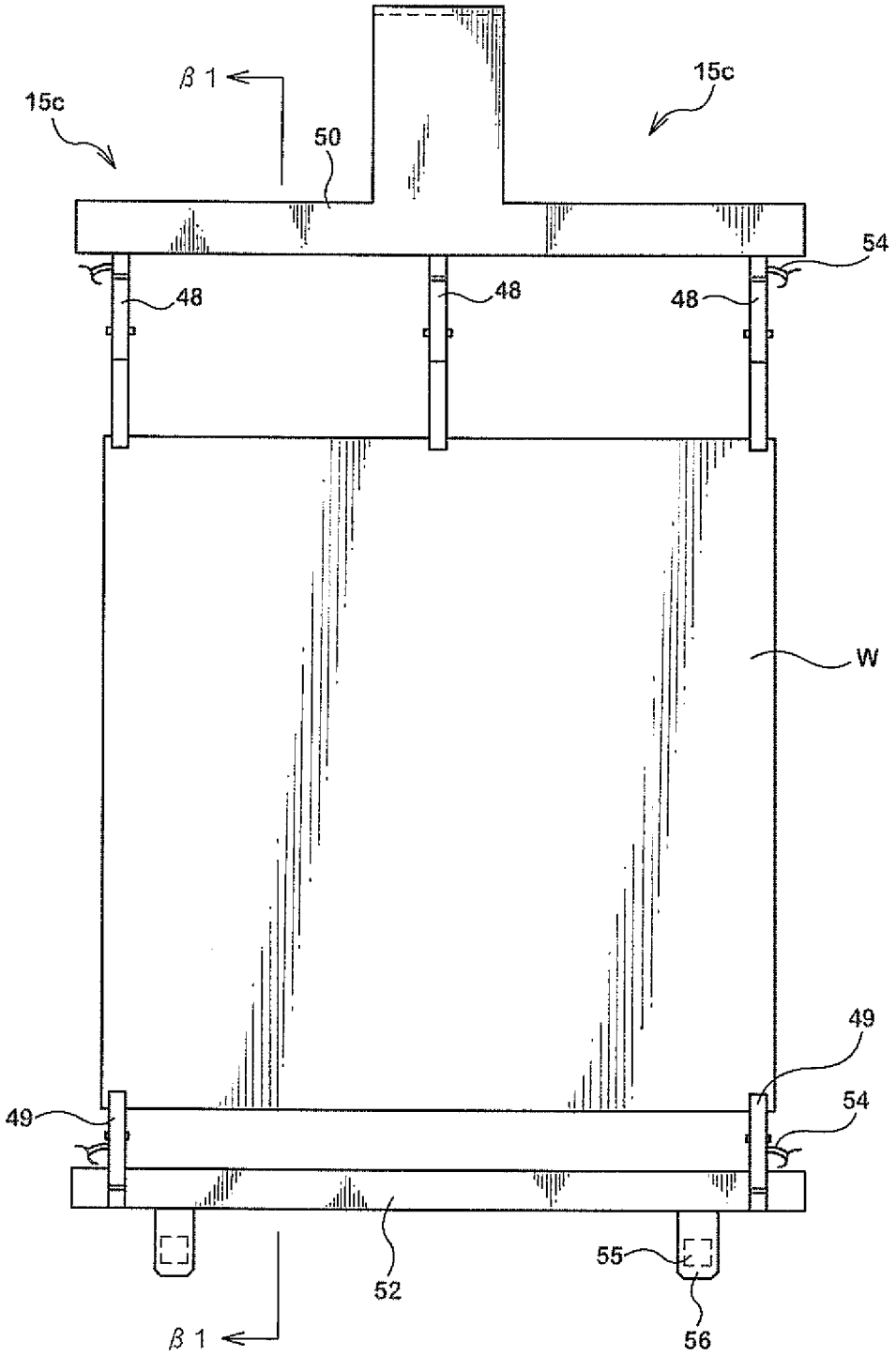
FIG. 15 is a front elevation view that illustrates a structure of a transport hanger 15*c* (no frame-body) according to another embodiment.

In the above embodiments, the frame-body member 51 is provided on the transport hanger 15*a* (FIGS. 4 and 5). However, the present invention is not limited thereto. As shown in FIG. 15, the frame-body member 51 may not necessarily be provided.

A transport hanger 15*c* shown in FIG. 15 has neither the frame-body member 51 nor the spring 53(63). The lower clamp 49 may be energized via the lead wire 54 connected to the upper clamp 48. Because the transport hanger 15*c* has no frame-body member 51, the plate-like work W can easily be loaded.

Figure 16:
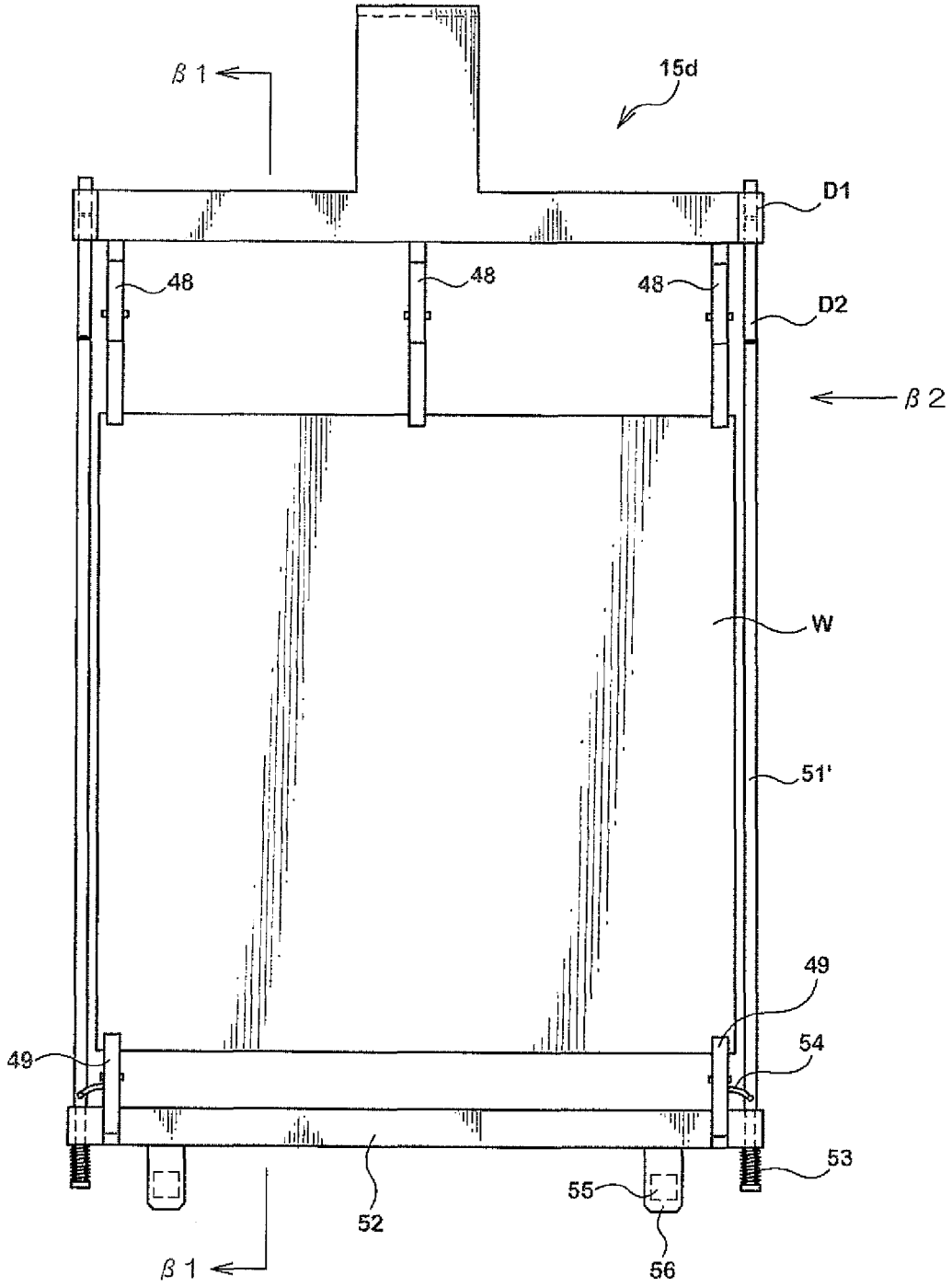
FIG. 16 is a front elevation view that illustrates a structure of a transport hanger 15*d* (upper and lower section movable type) according to another embodiment.
Figure 17B:
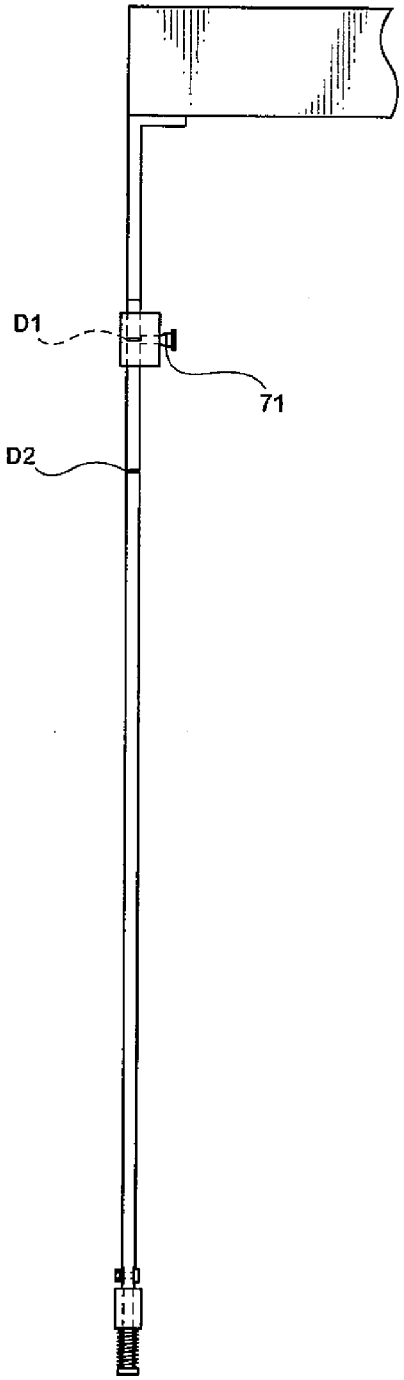
FIG. 17 are a cross-sectional view (FIG. 17A) taken along the line β1-β1 and a side view (FIG. 17B) seen from the β2 direction of the transport hanger 15*d* (upper and lower section movable type) according to another embodiment.
Figure 17A:
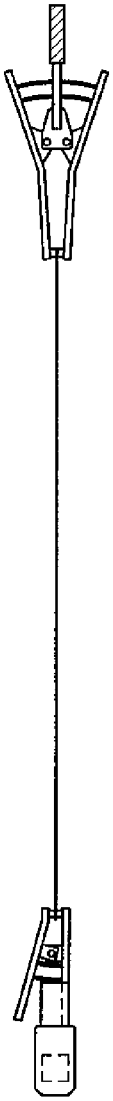

In the above embodiments, the upper-section movable type transport hanger 15*a* (FIG. 4) is described. However, as shown in FIGS. 16 and 17, a structure in which the length of the frame-body member 51 is adjustable with respect to the upper fixing member 50 may be employed. FIG. 16 is a front elevation view that illustrates a structure of an upper and lower section movable type transport hanger 15*d*. FIG. 17 are a cross-sectional view (FIG. 17A) taken along the line β1-β1 and a side view (FIG. 17B) seen from the β2 direction of the upper and lower section movable type transport hanger 15*d*, that respectively correspond to FIG. 4 and FIG. 5.

A frame-body member 51' of the transport hanger 15*d* shown in FIG. 16 is different from the transport hanger 15*a* shown in FIG. 4 in a point of view that the frame-body member 51' is inserted in a hole provided in the upper fixing member 50. Further, the frame-body member 51' of the transport hanger 15*d* is provided with a plurality of notches D1, D2 with which a tip of a plunger 71 shown in FIG. 17B is engaged to fix the frame-body member 51' at a predetermined position corresponding to the length of the plate-like work W.

In the above embodiments, the lower guide rail 14 is fixed on the bottom of the plating tank 2. However, as shown in FIG. 18, a height adjuster 220 for adjusting the height of the lower guide rail 14 may be provided.

Figure 18:
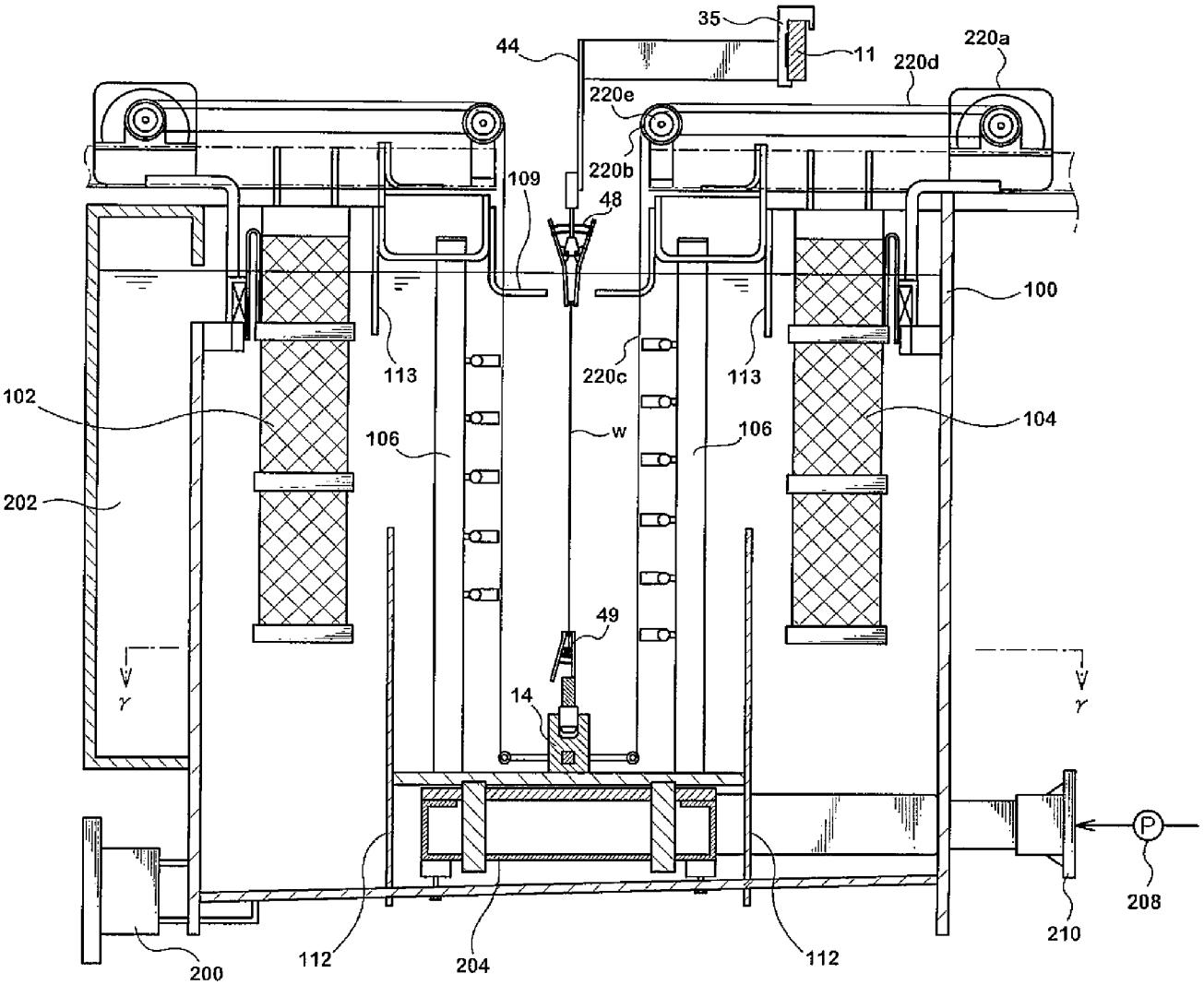
FIG. 18 is a view that illustrates a structure of a plating tank 2*c* according to another embodiment.

The height adjuster 220 shown in FIG. 18 includes a drive motor 220*a*, a pulley 220*b*, a connecting wire 220*c* and a drive belt 220*d*. One end of the connecting wire 220*c* is fixed to the pulley 220*b* and the other end of the connecting wire 220*c* is connected to the lower guide rail 14. The lower guide rail 14 is lifted to a predetermined height by rewinding the connecting wire 220*c* with the pulley 220*b* driven by the drive motor 220*a*.

Although a spring is used as an elastic member in the above embodiments, other elastic members (rubber etc.) may be used.

Further, in the above embodiments, the upper clamp 48 and the lower clamp 49 are adapted to be relatively movable via the spring 53 as elastic member (FIG. 3 etc.). However, the elastic member may not necessarily be provided.

Figure 19:
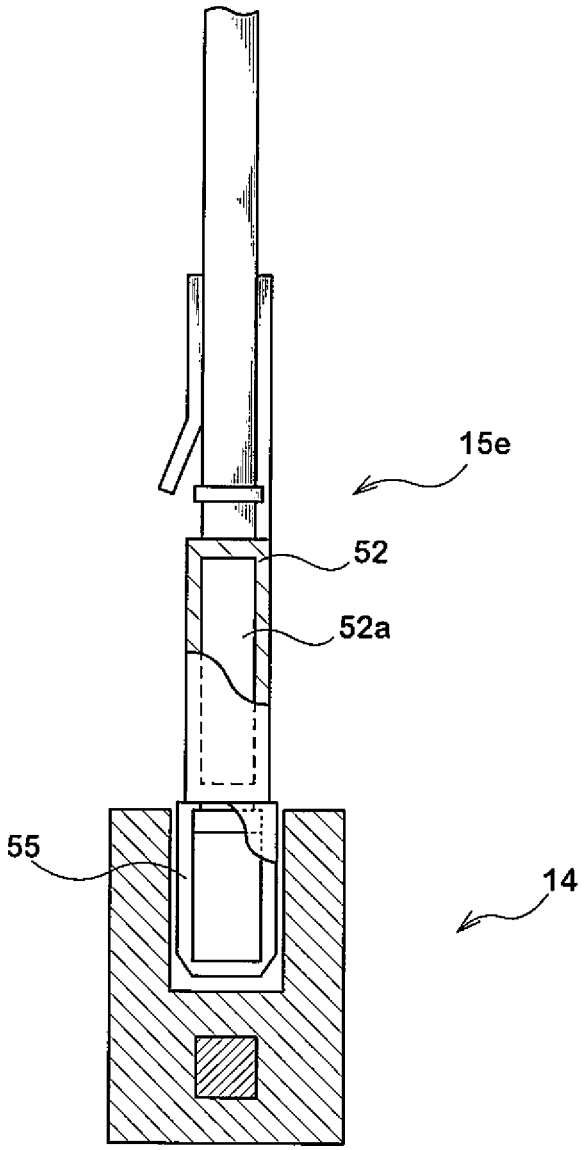
FIG. 19 is a view that illustrates a structure of a transport hanger 15*e* according to another embodiment.

Impact to the plate-like work W can be mitigated, for example, by effecting buoyancy by providing a hollow 52*a* inside the lower fixing member 52 in the plating tank 2 as shown in FIG. 19 with or even without the spring 53 shown in FIG. 3.

In the above embodiments, buoyancy FB is considered to be small enough to be negligible (FIG. 8). Here, the case where buoyancy FB is not negligible will be described.

Considering of the buoyancy FB shown in FIG. 8, before the transport hanger 15*a* lowered into the plating tank 2 reaches the lower guide rail 14, the transport hanger 15*a* receives the force FS1 of the spring 53, the lower load M (total weight of the lower clamp 49, the lower fixing member 52, the guide bar 55 etc.) of the transport hanger 15*a* and the buoyancy FB. Accordingly, equilibrium of forces is represented by an equation [2×FS1+FB=M]. At this time, the shrinkage of spring X1 is obtained as X1=(M−FB)/2k by substituting the above equation into an equation [FS1=k×X1].

Before the transport hanger 15*a* is lowered into the plating tank 2, equilibrium of forces is represented by an equation [2×FS0=M] since the buoyancy FB is not generated. At this time, the shrinkage X0 of the spring relative to the natural length is derived as X0=M/2k from FS0=k×X0. Because X0>X1, the spring 53 expands by FB/2k (=X0−X1) to move the transport hanger 15*a* upward after the transport hanger 15*a* is lowered into the plating tank 2.

As shown in FIG. 8, after the transport hanger 15*a* reaches the lower guide rail 14, the transport hanger 15*a* further receives the attractive force Fm(r) generated against the lower guide rail 14 in addition to the force FS2 (>FS1) of the spring 53, the lower load M (total weight of the lower clamp 49, the lower fixing member 52, the guide bar 55 etc.) and the buoyancy FB. Accordingly, equilibrium of forces after an attractive force is generated is represented by an equation [2×FS2+FB=M+2×Fm(r)].

A necessary condition for the plate-like work W to have vertical tension is such that the total of the lower load M and double the attractive force of Fm(r) is larger than the total of an upward force of the spring 53 (2×FS2) and the buoyancy FB. That is, when X2 is defined as the shrinkage of the spring relative to the natural length, the attractive force Fm(r) is derived as Fm(r)>k X2+(FB−M)/2 from an equation [M+2×Fm(r)>2×k X2+FB].

In the above embodiments, an attractive force is obtained by providing the metallic piece 56 in the guide bar 55 of the transport hanger 15 and providing the permanent magnet 61 in the lower guide rail 14. The present invention is not limited thereto. The guide bar 55 of the transport hanger 15 may be provided with a permanent magnet and the lower guide rail 14 may be provided with a metallic piece, or both of these may be provided with a permanent magnet.

Further, a resin sheet may be attached to cover the guide groove 62 and an upper surface of the lower guide rail 14 (FIG. 7). This gives a merit to easily remove iron powder deposited on the guide groove 62 only by peeling off the resin sheet.

In the above embodiments, the guide groove 62 is provided in the lower guide rail 14 (FIG. 7). The present invention is not limited thereto. The guide groove 62 may not necessarily be provided. A recessed guide groove may be provided on the transport hanger 15 and a projected guide may be provided in the lower guide rail 14.

Figure 27:
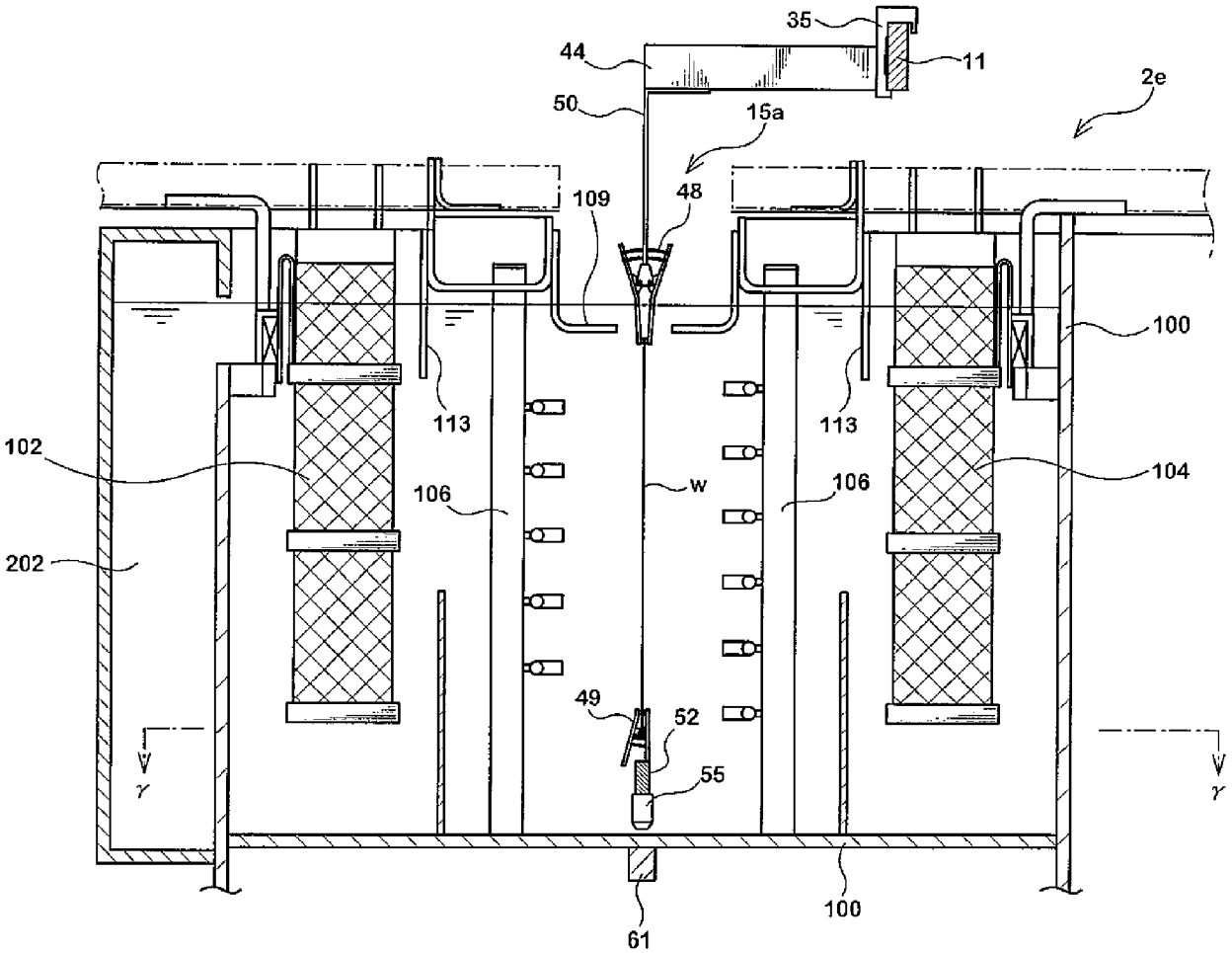
FIG. 27 is a view that illustrates a structure of a plating tank 2*e* according to another embodiment.

In the above embodiments, the lower guide rail 14 provided with the permanent magnet 61 is provided in the tank body 100. The present invention is not limited thereto. The permanent magnet 61 may be provided outside the tank body 100 to generate an attractive force as in a plating tank 2*e* shown in FIG. 27. In this case, the tank body 100 is preferably made of nonmagnetic material.

In the above embodiments, a permanent magnet is used to generate an attractive force. The present invention is not limited thereto. An electromagnet may be employed.

In the above embodiments, only the upper clamp 48 has a double clamp structure (FIG. 5A). However, only the lower clamp 49 or both the upper clamp 48 and the lower clamp 49 may have a double clamp structure.

In the above embodiments, the clamp is formed symmetrical with respect to the plate-like work W. However, the clamp may be formed in any shape as long as the current flow path is identical between in both sides of the plate-like work W.

Although a hole of the porous body H is formed in a honeycomb shape (FIG. 14) in the above embodiments, it may be formed in other shape. Although a hole of the porous body H has a uniform cross section in the above embodiments, a tapered hole or a hole whose central part is wide and both ends are narrow may be used.

In the above embodiments, two porous electrodes P1, P2 shown in FIG. 12 are provided. However, those may be omitted and only the sparger 106 and the porous body H for example may be combined.

In the above embodiments, the sparger 106 shown in FIG. 12 is provided. However, it may be omitted and only two porous electrodes P1, P2 and the porous body H for example may be combined.

In the above embodiments, the porous body H shown in FIG. 12 is provided. However, it may be omitted and only two porous electrodes P1, P2 and the sparger 106 for example may be combined.

Figure 20:
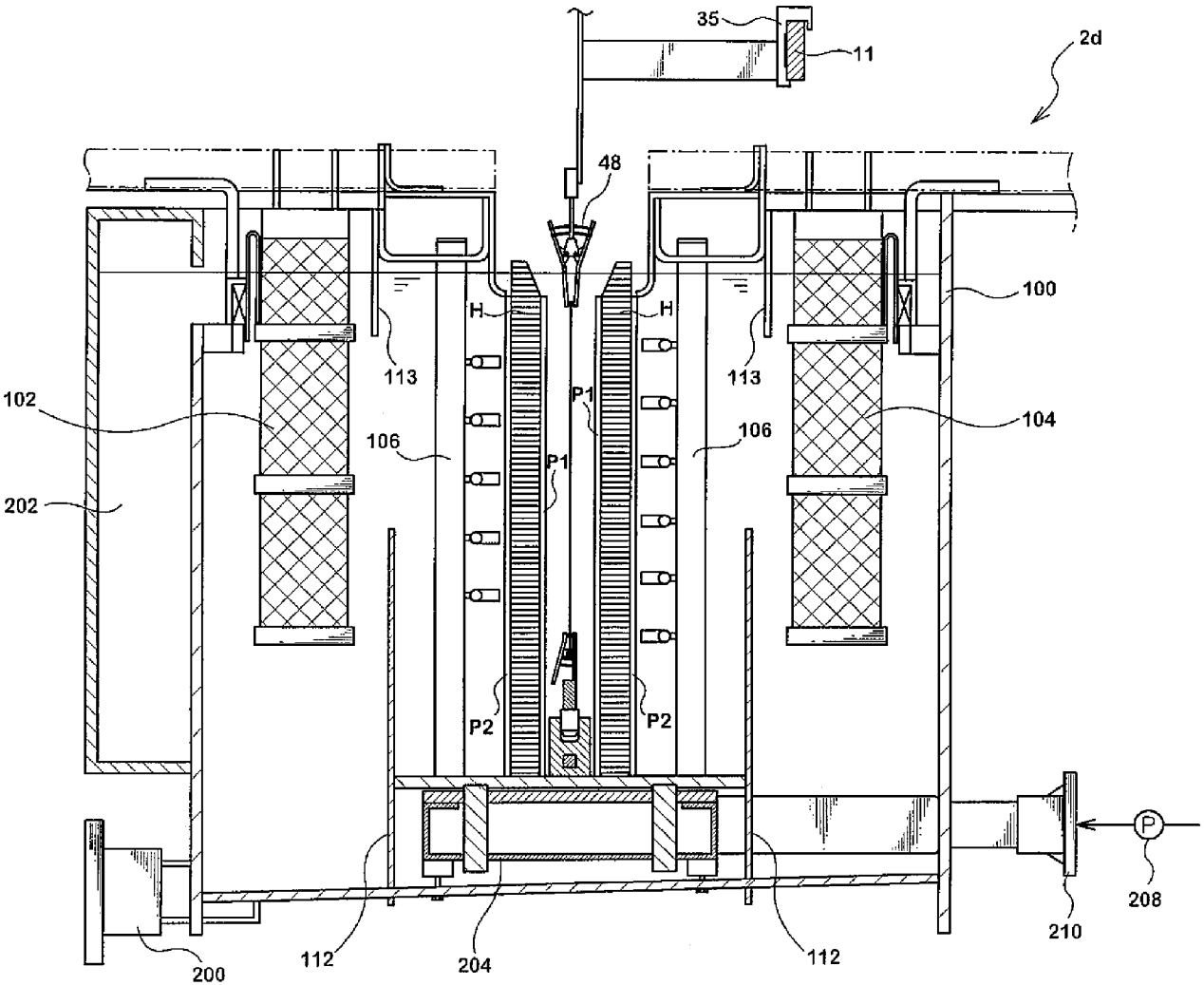
FIG. 20 is a view that illustrates a structure of a plating tank 2*d* according to another embodiment.

In the above embodiments, the porous body H is formed flat. However, it may be notched following the shape of the upper clamp 48 to keep a predetermined spacing therebetween as shown in FIG. 20.

In the above embodiments, plate processing is performed using the surface treating apparatus 300 provided with the rise-and-fall guide rails 10, 12. However, the present invention may be implemented with a surface treating apparatus without a rise-and-fall mechanism (for example, surface treating apparatus provided with an ebb-and-flow tank as disclosed in JP-A-2010-121185, JP-A-2010-106288 and JP-A-2010-100898).

6. Each Transport Mechanism of Surface Treating Apparatus 300

Figure 21:
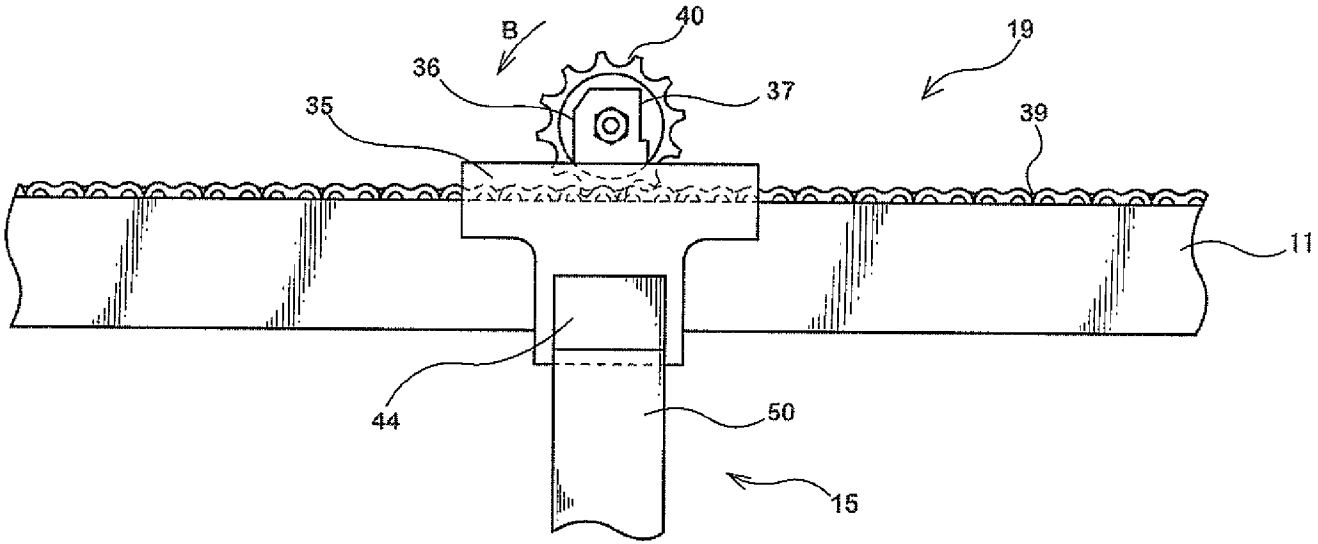
FIG. 21 is a front elevation view of a mechanism that transports the transport hanger 15*a;*
Figure 22:
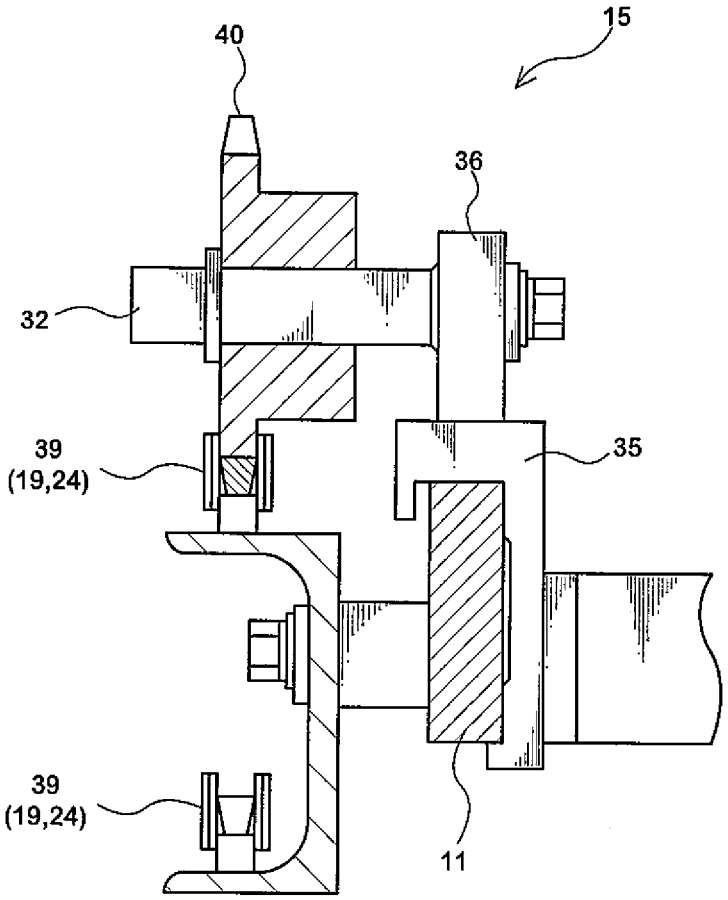
FIG. 22 is a central cross-sectional view of the mechanism that transports the transport hanger 15*a;*

Referring to FIG. 21 etc., the transport mechanism of the transport hanger 15 will be described. FIG. 21 is a front elevation view that illustrates the structure of the transport hanger 15*a* that is provided on the fixed guide rail 11. FIG. 22 is a central cross-sectional view of the transport hanger 15*a* and the fixed guide rail 11 shown in FIG. 21.

As shown in FIG. 21, the transport hanger 15 has the slide member 35 which contact slidably with the fixed guide rail 11, and the connecting member 44 for connecting such members. Copper and brass are used for the material of the slide member 35 and the connecting members 44.

As shown in FIG. 22, a bearing 36 is fixed on the slide member 35 which has a gear 40 engaging with chain belt 39 (which is comprising the linear transporter 19 in FIG. 1) of one-way clutch type. Therefore, the gear 40 engaging with chain belt 39 on the fixed guide rail 11, 13 can rotate only in the direction of arrow B shown in FIG. 21 when feeding forward etc.

The pusher contacting face 37 shown in FIG. 21 is a part contacted by the pusher 16 (16*a*-*d*), 21 (21*a*-*d*) (FIG. 23) of intermittent transporter 17, 22 which is transport means of the transport hanger 15.

The nail-hooking part 32 in FIG. 22 is a part contacted by the transport nail 30 (FIG. 1) of the positioning transporter 18 which is transport means of the transport hanger 15. These transporters of the transport hanger 15 will be described as follows.

The transport hanger 15 shown in FIG. 21 is transferred by the intermittent transporter 17, 22, the positioning transporter 18, 23, the linear transporter 19, 24, and the letting-off transporter 20, 25 in the surface treating apparatus 300 as follows.

First, the intermittent transporter 17, 22 attached on top of the rise-and-fall guide rails 10, 12 transport the transport hanger 15 pitch by pitch that is respectively placed at (c)-(f), (h)-(k) intermittently by using the pusher 16*a*-16*d*, 21*a*-21*d* (FIG. 23). FIG. 23 shows a plan view that illustrates the structure of the intermittent transporter 17 provided above the rise-and-fall guide rail 10.

The positioning transporter 18 shown in FIG. 2 is arranged along the fixed guide rail 11. The transport hanger 15, which has fallen into dipping spot 2*a* (board dipping position) at position (x) where is above the plating tank 2

(See FIG. 2), is transferred to the fixed guide rail 11 and fed forward until position (b). Then, a distance from the platy work W placed at afore position (a) is adjusted to predetermined width L1 (e.g. L1=5 mm).

Figure 24A:
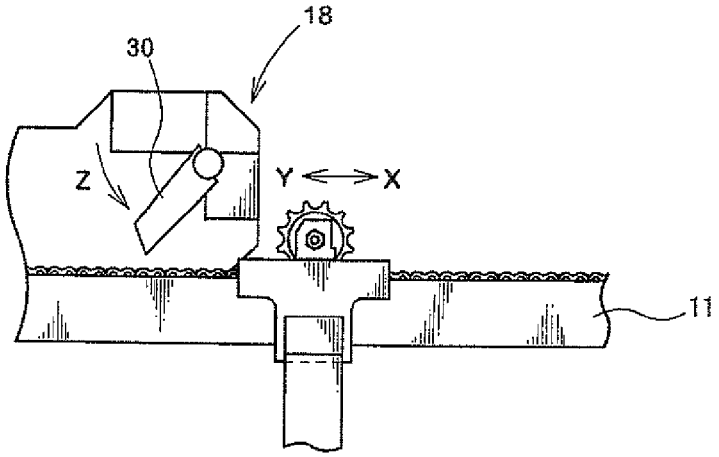
FIGS. 24A-24C are views that illustrate a structure of a positioning transporter 18.
Figure 24B:
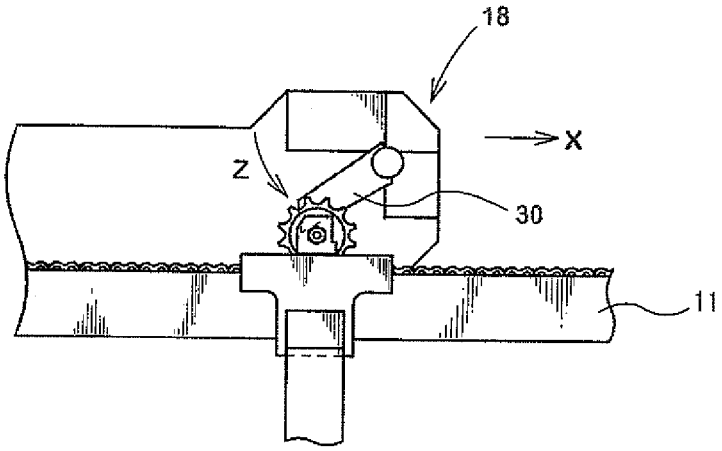
Figure 24C:
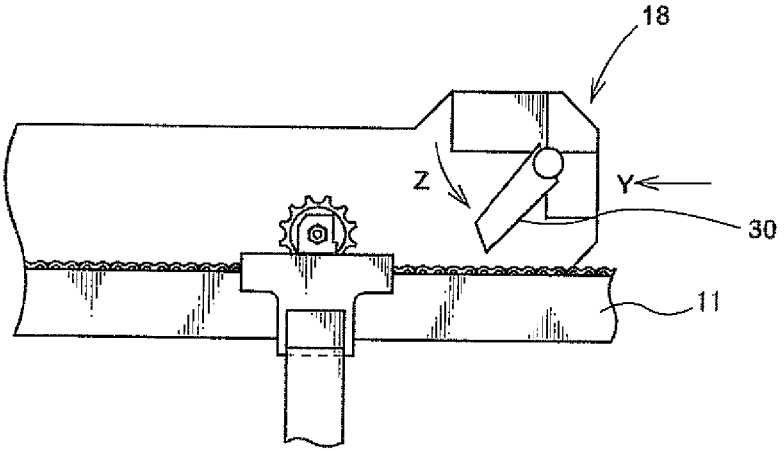
Figure 25B:
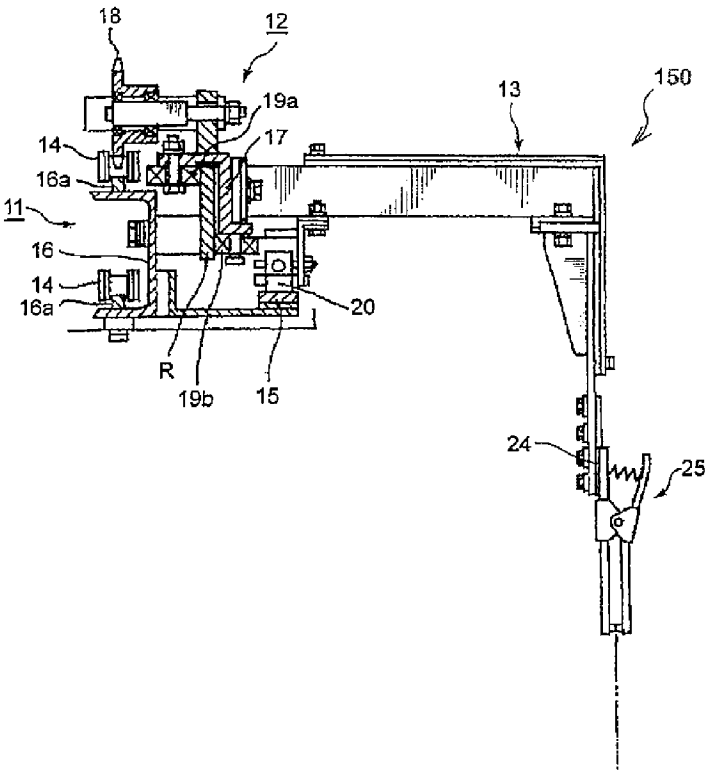
FIG. 25A is a front elevation view of the transport hanger 150 and FIG. 25B is a cross-sectional view thereof taken along the line A-A.
Figure 25A:
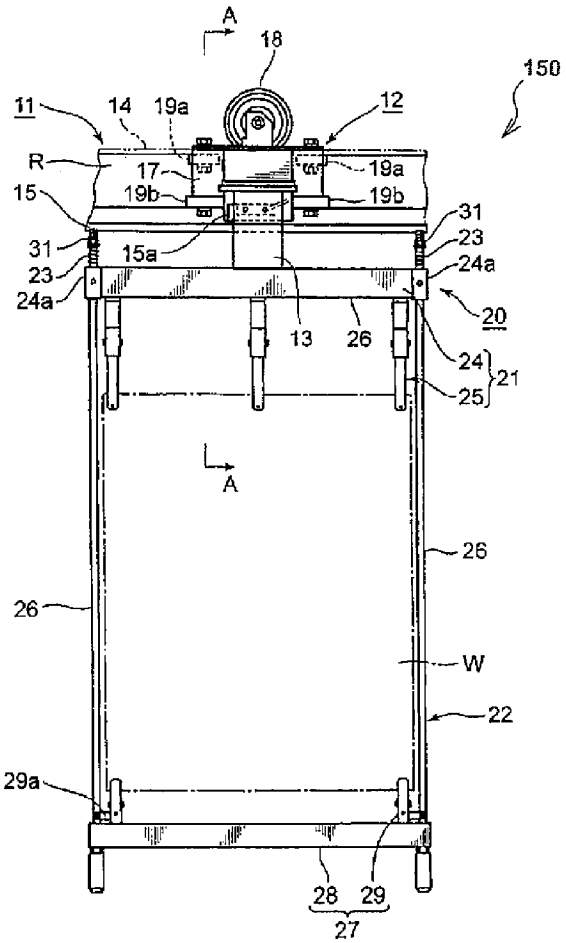
Figure 26:
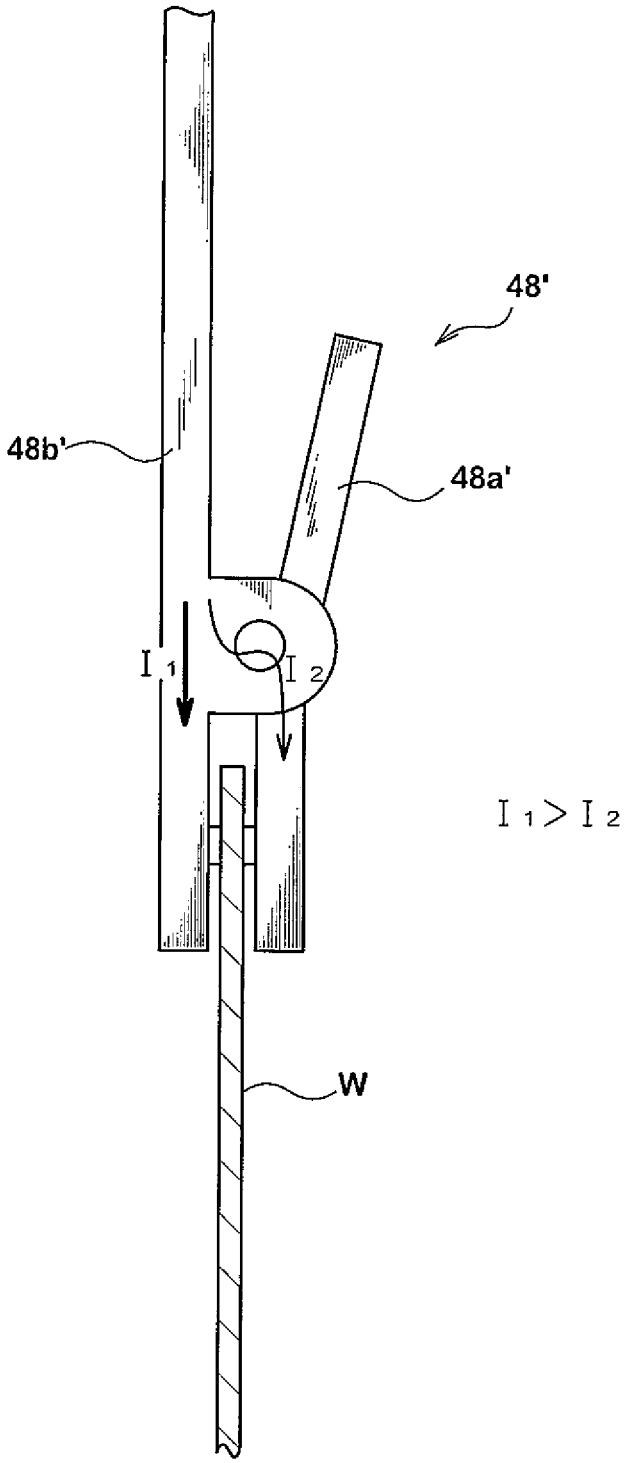
FIG. 26 is a view that illustrates a shape of a clamp 48' of a related art.

FIG. 24 shows the structure of positioning transporter 18. The positioning transporter 18 shown in FIG. 24 is movable back and forth in the direction of arrows X, Y along rail which is arranged separately from the fixed guide rail 11, and having a transport nail 30 biased in the direction of arrow Z by spring in the condition shown FIG. 24A. Therefore, the transport nail 30 firstly pass through the nail-hooking part shown in FIG. 22 by shrinking the spring (state as shown in FIG. 24B) when transporting the transport hanger 15. After that, the transport hanger 15 is transferred to the direction of arrow B1 shown in FIG. 2, as the positioning transporter 18 moves in the opposite direction (the direction of arrow Y in FIG. 24C) and the transport nail 30 hooks the nail-hooking part 32 of transport hanger 15. At this time, the moving speed of the positioning transporter 18 is needed to be faster than moving speed of the linear transporter 19 (i.e. the moving speed of the chain belt 39) in order to catch up a foregoing transport hanger 15 that the linear transporter 19 is transporting. Also, the structure and the movement of positioning transporter 23 of strip tank 6's side are same as positioning transporter 18 of plating tank 2' s side shown in FIG. 24.

The linear transporter 19, 24 transports the transport hanger 15 which is fed forward by the positioning transporter 18, 23 with keeping a predetermined distance (to the direction of arrow B1 and B2 in FIG. 1).

The letting-off transporters 20, 25 transfer the transport hanger 15, which has been transported by the linear transporter 19, 24 respectively until the position (g) and (o), respectively to the position (h) and (f) position of the rise-and-fall guide rails 10, 12 (FIG. 14). Also, the structure and the movement of the letting-off transporter 20, 25 are same as the positioning transporter 18 shown in FIG. 24.

What is claimed is:

1. A surface treating apparatus for electroplating, comprising:

a transport hanger that transports a thin processing object;

a plating tank having a tank body that stores a plating solution; and a rise-and-fall mechanism that lowers the transport hanger loaded with the thin processing object into the plating tank and lifts the transport hanger from the plating tank after performing plate processing on the thin processing object, wherein the transport hanger includes an upper gripper that grips an upper part of the thin processing object and a lower gripper that grips a lower part of the thin processing object, and the plating tank includes an upper guide rail that transports the transport hanger in a predetermined moving direction and a member that is provided at a predetermined position of the tank body and that generates an attractive force against the lower gripper of the transport hanger, further wherein a magnetic material is provided within a bottom part of the transport hanger, and the member generates a downward attractive force to stretch the thin processing object, the transport hanger further comprising a plurality of frame-body members interconnecting the upper gripper and the lower gripper each frame-body member having an associated elastic member, wherein the thin processing object is configured to receive a load from the lower gripper through an interaction between the elastic members and the member that generates the downward attractive force, and the lower gripper of the transport hanger moves, from a first position of use further from the member, downward, to a second position of use, toward and closer to the member against the force of the elastic member to place the processing object in the second position of use in a stretched state.

2. A plating tank for electroplating a thin processing object, comprising:

a tank body that is provided to extend in a moving direction the thin processing object and store a plating solution;

a positive electrode provided in the tank body;

a transport hanger moving in the moving direction while holding the thin processing object and including an upper gripper and a lower gripper for respectively gripping the thin processing object at an upper and a lower parts thereof;

an upper guide rail that is provided above the tank body that transports the transport hanger in the moving direction; and a member that is provided at a predetermined position of the tank body that generates an attractive force against the lower gripper of the transport hanger, further wherein a magnetic material is provided within a bottom part of the transport hanger and the member generates a downward attractive force to stretch the thin processing object, the transport hanger further comprising a plurality of frame-body members interconnecting the upper gripper and the lower gripper, each frame-body member having an associated elastic member, wherein the thin processing object is configured to receive a load from the lower gripper through an interaction between the elastic members and the member that generates the downward attractive force, and the lower gripper of the transport hanger moves, from a first position of use further from the member, downward, to a second position of use toward and closer to the member against the force of the elastic member to place the processing object in the second position of use in a stretched state.

3. The plating tank of claim 2, wherein each frame-body member connects the upper gripper and the lower gripper to form a frame body.

4. The plating tank of claim 3, wherein each frame-body member of the transport hanger is integrally coupled to the upper gripper, and the lower gripper of the transport hanger is adapted to be movable relative to each respective frame-body member.

5. The plating tank of claim 3, wherein each frame-body member of the transport hanger is integrally coupled to the lower gripper, and the upper gripper of the transport hanger is adapted to be movable relative to each respective frame-body member.

6. The plating tank of claim 2, wherein the thin processing object receives a load from the lower gripper via the elastic member and is balanced at a predetermined position to have no tension before an attractive force is generated between the member that generates an attractive force and the lower gripper of the transport hanger, and the lower gripper of the transport hanger stretches relative to the upper gripper against the force of the elastic member to make the thin processing object be in the stretched state after an attractive force is generated between the member that generates an attractive force and the lower gripper of the transport hanger.

7. The plating tank of claim 2, wherein the transport hanger includes a lower fixing member for fixing a plurality of the lower grippers, and a hollow is provided inside the lower fixing member.

8. The plating tank of claim 2, wherein a metallic piece is provided in the lower gripper of the transport hanger, a lower guide rail as the member that generates an attractive force against the lower gripper of the transport hanger is provided at a predetermined position in the tank body, and permanent magnets are continuously provided in the lower guide rail along the direction of transportation.

9. The plating tank of claim 8, wherein a guide groove extending in the direction of transportation is provided on the lower guide rail, and a hard magnetic material is placed on the bottom of the guide groove.

10. The plating tank of claim 8, wherein the spacing between the upper gripper and the lower gripper can be adjusted by changing the length of the frame-body member corresponding to the length of the thin processing object, and the vertical position of the lower guide rail can be adjusted corresponding to the length of the processing object.

11. The plating tank of claim 2, wherein at least the upper gripper out of the upper gripper and lower gripper of the transport hanger is structured to make the current flow path symmetrical between both sides of the thin processing object.

12. The plating tank of claim 11, wherein at least the upper gripper of the upper gripper and lower gripper of the transport hanger is formed symmetrical with respect to the thin processing object and corresponding parts on each side are made of the same material.

13. The plating tank of claim 2, further comprising a spouter for spouting the plating solution toward the thin processing object and an electric field restrictor that is interposed between the spouter and the thin processing object and has multiple long holes formed to be oriented to the processing object.

14. The plating tank of claim 13, wherein a long hole at a part to which the spouted plating solution is spouted from the spouter is formed smaller than a long hole at a part which is not hit by the spouted plating solution.

15. The plating tank of claim 13, wherein the electric field restrictor is notched following the shape of the upper gripper of the transport hanger.

16. The plating tank of claim 13, further comprising an electric field restrictor that is interposed between the spouter and the thin processing object and has multiple long holes formed to be oriented to the thin processing object and two conductive porous plates that sandwich the electric field restrictor therebetween and are electrically connected with each other.

17. A surface treating apparatus, comprising:

a first treatment tank in which a thin processing object, in a stretched state, is required to have a plating solution treatment;

a second treatment tank in which the processing object, in the stretched state, is not required to have the plating solution treatment; and a transport hanger moving in the treatment tank while holding the thin processing object and including an upper gripper and a lower gripper for respectively gripping the thin processing object at an upper and a lower parts thereof;

wherein the first treatment tank includes an upper guide rail for transporting the transport hanger provided in an upper part thereof and a member that is provided in a lower part thereof and generates at attractive force against the lower gripper of the transport hanger, and the second treatment tank includes an upper guide rail for transporting the transport hanger provided in an upper part thereof, further wherein a magnetic material is provided within a bottom part of the transport hanger and the member generates a downward attractive force to place the thin processing object in the stretched state, the transport hanger further comprising a plurality of frame-body members interconnecting the upper gripper and the lower gripper, each frame-body member having an associated elastic member, wherein the thin processing object is configured to receive a load from the lower gripper through an interaction between the elastic members and the member that generates the downward attractive force, and the lower gripper of the transport hanger moves, from a first position of use further from the member, downward, to a second position of use, toward and closer to the member against the force of the elastic member to place the processing object in the second position of use in a stretched state.

* * * * *